US010283886B2

(12) United States Patent
Hasegawa et al.

(10) Patent No.: US 10,283,886 B2
(45) Date of Patent: May 7, 2019

(54) ELECTRICAL CONNECTOR FOR CIRCUIT BOARDS AND METHOD OF MANUFACTURE THEREOF

(71) Applicant: Hirose Electric Co., Ltd., Shinagawa-ku, Tokyo (JP)

(72) Inventors: Yohei Hasegawa, Tokyo (JP); Takahiro Abe, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/056,154

(22) Filed: Aug. 6, 2018

(65) Prior Publication Data

US 2019/0052005 A1 Feb. 14, 2019

(30) Foreign Application Priority Data

Aug. 9, 2017 (JP) ..... 2017-154394

(51) Int. Cl.

| | |
|---|---|
| ***H01R 12/00*** | (2006.01) |
| ***H01R 12/71*** | (2011.01) |
| ***H01R 12/72*** | (2011.01) |
| ***H01R 13/631*** | (2006.01) |
| ***H01R 13/405*** | (2006.01) |

(52) U.S. Cl.

CPC ..... *H01R 12/716* (2013.01); *H01R 12/722* (2013.01); *H01R 13/405* (2013.01); *H01R 13/6315* (2013.01)

(58) Field of Classification Search

CPC ..... H01R 23/725; H01R 23/7073; H01R 13/6315; H01R 13/631

USPC ..... 439/74, 660, 247, 348

See application file for complete search history.

(56) References Cited

U.S. PATENT DOCUMENTS

| | | | | |
|---|---|---|---|---|
| 7,344,387 | B2 * | 3/2008 | Shiroyama | H01R 13/20 439/660 |
| 9,698,508 | B2 * | 7/2017 | Kobayashi | H01R 13/187 |
| 2007/0281519 | A1 * | 12/2007 | Shiroyama | H01R 13/20 439/108 |
| 2008/0296133 | A1 * | 12/2008 | Ura | H01R 13/6315 200/1 A |
| 2011/0294326 | A1 * | 12/2011 | Tanaka | H01R 12/712 439/248 |

FOREIGN PATENT DOCUMENTS

| | | | |
|---|---|---|---|
| JP | 2568142 | B2 | 12/1996 |

* cited by examiner

*Primary Examiner* — Phuong Chi T Nguyen
(74) *Attorney, Agent, or Firm* — Procopio, Cory, Hargreaves & Savitch LLP

(57) ABSTRACT

Stationary housings 20 involve stationary-side reinforcing fittings 80 secured in place in said stationary housings 20 via integral molding with said stationary housings 20 and, moreover, a movable housing involves movable-side reinforcing fittings 60, 70 secured in place in said movable housing 30 via integral molding with said movable housing. The stationary-side reinforcing fittings 80 involve exposed portions 82 exposed from the stationary housings 20 at locations outside the terminal array range of said terminals in the terminal array direction, and the movable-side reinforcing fittings 60, 70 involve expanded portions 63, 73 protruding from the movable housing 30 at locations outside the above-mentioned array range.

4 Claims, 10 Drawing Sheets

(B)

(A)

(B)

(A)

(B)

(A)

(B)

(A)

(B)

(A)

ELECTRICAL CONNECTOR FOR CIRCUIT BOARDS AND METHOD OF MANUFACTURE THEREOF

CROSS REFERENCE TO RELATED APPLICATIONS

This Paris Convention Patent Application claims benefit under 35 U.S.C. § 119 and claims priority to Japanese Patent Application No. JP 2017-154394, filed on Aug. 9, 2017, titled "ELECTRICAL CONNECTOR FOR CIRCUIT BOARDS AND METHOD OF MANUFACTURE THEREOF", the content of which is incorporated herein in its entirety by reference for all purposes.

BACKGROUND

Technical Field

The present disclosure relates to an electrical connector for circuit boards and to a method of manufacture thereof.

Related Art

In order to allow for a mating connection with a counterpart connector component even in the event of offset from the normal position, it is common to use electrical connectors for circuit boards provided with stationary housings, which are mounted to a circuit board, and movable housings, which have arranged therein the contact portions of terminals connectable to the above-described counterpart connector component and which, as is the case in so-called floating connectors, are movable relative to said stationary housings. One example of such a connector is disclosed in Patent Document 1.

The connector of Patent Document 1, which is formed by side walls and end walls such that its shape is of an elongated rectangular frame-like configuration when viewed in a direction normal to the surface of the circuit board (in the direction of connection with a counterpart connector component, in the heightwise direction of the connector), has a stationary housing (outer housing), whose longitudinal direction is the direction in which said side walls extend, and a movable housing (inner housing) disposed within in the interior space of said stationary housing. Multiple terminals spanning the distance between the two housings are arranged in the above-mentioned longitudinal direction. The above-mentioned movable housing is arranged at a location within the space enclosed by the side walls of the above-mentioned rectangular frame-like housing. In Patent Document 1, the terminals spanning the distance between the stationary and movable housings are attached to both housings by press-fitting. However, if the stationary and movable housings are formed separately from each other, when the terminals are press-fitted, the positional relationship of both housings becomes unstable, which makes automatic press-fit assembly difficult. Thus, in Patent Document 1, in order to stabilize the positional relationship of both housings, prior to the press-fit assembly of the above-mentioned terminals, the stationary and movable housings are coupled using coupling pieces made of the same material as both housings and molded as a single member. After the press-fit assembly of the terminals, said coupling pieces are severed to separate the stationary and movable housings.

PRIOR ART LITERATURE

Patent Documents

[Patent Document 1] Japanese Patent No. 2568142

SUMMARY

Technical Problem to be Solved

There is a need to provide an electrical connector for circuit boards in which it is ensured that the cut surfaces are smooth and no debris is generated when the stationary and movable housings are separated after coupling and molding the stationary and movable housings with the terminals secured in place therein, as well as a method of manufacture thereof.

In Patent Document 1, the stationary and movable housings are coupled using coupling pieces made of the same material as both housings and molded as a single member. After press-fitting the terminals in both housings, the coupling pieces are severed, thereby obtaining a floating connector in which terminal attachment is rendered more convenient.

However, in Patent Document 1, the coupling pieces that are used to couple the two housings prior to the press-fit assembly of the terminals are made of the same components as both housings, in other words, of a plastic material, which can have adverse consequences. The plastics used as the material of construction for the housing often contain glass fiber with a view to ensure high strength for the housing.

Therefore, severing the coupling pieces requires cutting through plastics containing glass fiber of extremely high strength, which is why cutting blades are readily damaged with repeated use. Furthermore, the cut surfaces of the two housings obtained by severing the coupling pieces are not smooth and have irregular teeth-like notches. Moreover, for this reason, plastic dust is scattered around during the severing operation. As a result, the dimensional accuracy of the above-mentioned severed surfaces is inadequate and the subsequent processing of the plastic dust requires time and effort.

With these circumstances in mind, it is an object of the present disclosure to provide an electrical connector for circuit boards in which it is ensured that when the stationary and movable housings are separated by severing after coupling and molding the two housings with the terminals secured in place therein, the cut surfaces are smooth and no debris is generated, as well as a method of manufacture thereof.

Technical Solution to the Problem

According to the present disclosure, the above-described problem is solved by the following electrical connector for circuit boards according to a first example implementation and a method of manufacture of an electrical connector for circuit boards according to a second example implementation.

First Example Implementation

The electrical connector for circuit boards according to the first example implementation involves terminals having formed therein connecting portions configured to be connected to a circuit board at one end in the longitudinal direction of said terminals and contact portions configured to be placed in contact with a counterpart connector component at the other end, and a housing holding a plurality of said terminals in array form; said housing comprises stationary housings, which are mounted to a circuit board by means of the above-mentioned terminals, and a movable housing, which is formed as a member separate from said stationary housings, is movable relative to said stationary housings, and has disposed therein the contact portions of the above-mentioned terminals.

In such an electrical connector for circuit boards according to the first example implementation, the above-mentioned terminals comprise stationary-side retained portions held in place by the stationary housings, movable-side retained portions held in place by the movable housing, and resilient portions provided between said stationary-side retained portions and movable-side retained portions. The above-mentioned stationary housings comprise stationary-side reinforcing fittings secured in place in said stationary housings via integral molding with said stationary housings and, moreover, the movable housing comprises movable-side reinforcing fittings secured in place in said movable housing via integral molding with said movable housing. The stationary-side reinforcing fittings comprise exposed portions exposed from the stationary housings at locations outside the terminal array range of the terminals in the terminal array direction, and the movable-side reinforcing fittings comprise expanded portions protruding from the movable housing at locations outside the above-mentioned array range.

In the first example implementation, the movable-side reinforcing fittings comprise expanded portions protruding from the movable housing and, moreover, the stationary-side reinforcing fittings comprise exposed portions exposed from the stationary housings. Therefore, when the connector is manufactured, the above-mentioned expanded portions and the above-mentioned exposed portion are coupled, thereby providing a reinforcing fitting blank, in which the movable-side reinforcing fittings and the stationary-side reinforcing fittings are formed as a single unit. The above-mentioned reinforcing fitting blank is molded integrally with the movable housing and stationary housings, thereby providing for excellent accuracy in the respective positional relationship of the movable housing and stationary housings. The movable-side reinforcing fittings and the stationary-side reinforcing fittings are then obtained by severing and separating the above-mentioned expanded portions and exposed portions. Since the above-mentioned reinforcing fitting blank is made of metal, almost no debris is generated when cutting the reinforcing fitting blank in comparison with cutting conventional plastics containing glass fiber. In addition, the cutting blade does not get damaged and, moreover, since the cut surfaces of the reinforcing fitting blank are smooth, the dimensional accuracy of the movable-side reinforcing fittings and stationary-side reinforcing fittings is also excellent.

In the first example implementation, the expanded portions of the movable-side reinforcing fittings and the exposed portions of the stationary-side reinforcing fittings may be provided in mutually different locations in the vertical direction. Thus, providing the above-mentioned expanded portions and the above-mentioned exposed portions in mutually different locations in the vertical direction makes it possible to prevent the expanded portions of the movable-side reinforcing fittings secured in place in said movable housing from abutting the exposed portions of the stationary reinforcing fittings when the movable-side housing moves in a direction parallel to the surface of the circuit board. As a result, damage to the above-mentioned expanded portions and exposed portions can be prevented.

Second Example Implementation

The method of manufacture of an electrical connector for circuit boards according to the second example implementation is a method of manufacture of an electrical connector for circuit boards wherein the connector comprises terminals having formed therein connecting portions configured to be connected to a circuit board at one end in the longitudinal direction of said terminals and contact portions configured to be placed in contact with a counterpart connector component at the other end, and a housing holding a plurality of said terminals held in place in array form, and wherein said housing comprises stationary housings, which are mounted to a circuit board by means of the above-mentioned terminals, and a movable housing, which is formed as a member separate from said stationary housings, is movable relative to said stationary housings, and has disposed therein the contact portions of the above-mentioned terminals arranged therein.

In such a method of manufacture, in the second example implementation, the terminals, which comprise stationary-side retained portions held in place by the stationary housings, movable-side retained portions held in place by the movable housing, and resilient portions provided between said stationary-side retained portions and movable-side retained portions, are secured in place in the above-mentioned stationary and movable housings via integral molding. Moreover, the reinforcing fitting blank is secured in place via integral molding in the above-mentioned stationary and movable housings so as to span the distance between said stationary and movable housings. After the terminals, the reinforcing fitting blank, and the stationary and movable housings are integrally molded together, parts of the above-mentioned reinforcing fitting blank exposed from both the stationary housings and the movable housing at locations outside of the terminal array range in the terminal array direction are severed, with some material remaining after the severing operation, as a result of which the stationary-side reinforcing fittings secured in place in the stationary housings and movable-side reinforcing fittings secured in place in the movable housing are separated, and the exposed portions of the stationary-side reinforcing fittings exposed from the stationary housings at locations outside the above-mentioned terminal array range and the expanded portions of the movable-side reinforcing fittings protruding from the movable housing at locations outside the above-mentioned terminal array range are positioned in close proximity but without direct contact.

In this second example implementation, in the same manner as previously discussed in connection with the first example implementation, the movable housing and stationary housings are molded integrally with one reinforcing fitting blank, thereby ensuring excellent accuracy for the respective positional relationship between the movable housing and the stationary housings. Further, since the above-mentioned reinforcing fitting blank is made of metal, almost no debris is generated when cutting the reinforcing fitting blank. In addition, the cutting blade does not get damaged and, moreover, since the cut surfaces of the reinforcing fitting blank are smooth, the dimensional accuracy of the movable-side reinforcing fittings and stationary-side reinforcing fittings is also excellent.

In the second example implementation, the reinforcing fitting blank may be adapted to comprise a stepped portion with level differences in the vertical direction in a section located outside of the terminal array range. The above-mentioned reinforcing fitting blank is cut so as to excise the section that includes the above-mentioned stepped portion, thereby providing the exposed portions of the stationary-side reinforcing fittings and the expanded portions of the movable-side reinforcing fittings at different locations in the vertical direction.

Thus, as a result of providing the above-mentioned exposed portions of the stationary-side reinforcing fittings and the above-mentioned expanded portions of the movable-side reinforcing fittings in different locations in the vertical direction, in the same manner as previously described in connection with the first example implementation, the expanded portions of the movable-side reinforcing fittings secured in place in said movable housing are prevented from abutting the exposed portions of the stationary reinforcing fittings when the movable-side housing moves in a direction parallel to the surface of the circuit board. Therefore, damage to the above-mentioned expanded portions and exposed portions can be prevented.

Technical Effect

In the present disclosure, as described above, a single reinforcing fitting blank, in which the exposed portions of the stationary-side reinforcing fittings and the expanded portions of the movable-side reinforcing fittings are coupled, is molded integrally with the stationary housings and the movable housing, thereby providing for excellent accuracy of relative positioning of the two housings during integral molding. In addition, almost no debris is generated by cutting the reinforcing fitting blank when the stationary-side reinforcing fittings and movable-side reinforcing fittings are obtained by cutting said reinforcing fitting blank, and the subsequent processing of the debris is easier because the above-mentioned reinforcing fitting blank is made of metal. In addition, the cutting blade does not get damaged and, moreover, since the cut surfaces of the reinforcing fitting blank are smooth, the dimensional accuracy of the movable-side reinforcing fittings and stationary-side reinforcing fittings is also excellent.

BRIEF DESCRIPTION OF THE DRAWINGS

FIGS. 1(A) and 1(B) illustrate an external perspective view of a connector assembly according to an example implementation of the present disclosure, which has a plug connector and a receptacle connector matedly connected thereto, wherein FIG. 1(A) illustrates a state prior to mating connection and FIG. 1(B) illustrates a state subsequent to mating connection.

FIGS. 2(A) and 2(B) illustrate a cross-sectional perspective view illustrating the inside of the two connectors of FIGS. 1(A) and 1(B), wherein FIG. 2(A) is a state prior to mating connection corresponding to FIG. 1(A) and FIG. 2(B) is a state subsequent to mating connection corresponding to FIG. 1(B).

FIGS. 5(A) and 5(B) illustrate a cross-sectional view taken at the location of the signal terminals of the two connectors of FIG. 1, wherein FIG. 5(A) is a state prior to mating connection corresponding to FIG. 1(A), and FIG. 5(B) is a state subsequent to mating connection corresponding to FIG. 1(B).

FIGS. 6(A) and 6(B) illustrate a cross-sectional view taken at the location of the retaining and retained fittings of the two connectors of FIGS. 1(A) and 1(B), wherein FIG. 6(A) is a state prior to mating connection corresponding to FIG. 1(A) and FIG. 6(B) is a state subsequent to mating connection corresponding to FIG. 1(B).

FIGS. 8(A) and 8(B) illustrate a perspective view illustrating a state in which the receiving-side housing and carrier-equipped anchor fittings are integrally molded in the process of manufacture of the receptacle connector, wherein FIG. 8(A) illustrates the receiving portion in an upwardly open orientation and FIG. 8(B) illustrates an orientation flipped over relative to FIG. 8(A).

FIGS. 9(A) and 9(B) illustrate a perspective view illustrating a state in which receptacle terminal blanks are held in the receiving-side housing in the process of manufacture of the receptacle connector, wherein FIG. 9(A) illustrates an orientation corresponding to FIG. 8(A) and FIG. 9(B) illustrates an orientation corresponding to FIG. 8(B).

FIGS. 10(A) and 10(B) illustrate a perspective view illustrating a state in which the terminal blanks of FIGS. 9(A) and 9(B) are molded integrally with the board-side housing in the process of manufacture of the receptacle connector, wherein FIG. 10(A) illustrates an orientation corresponding to FIG. 9(A) and FIG. 10(B) illustrates an orientation corresponding to FIG. 9(B).

DETAILED DESCRIPTION

As indicated below, example implementations of the present disclosure will be described with reference to the accompanying drawings.

Figures 1A, 1B:
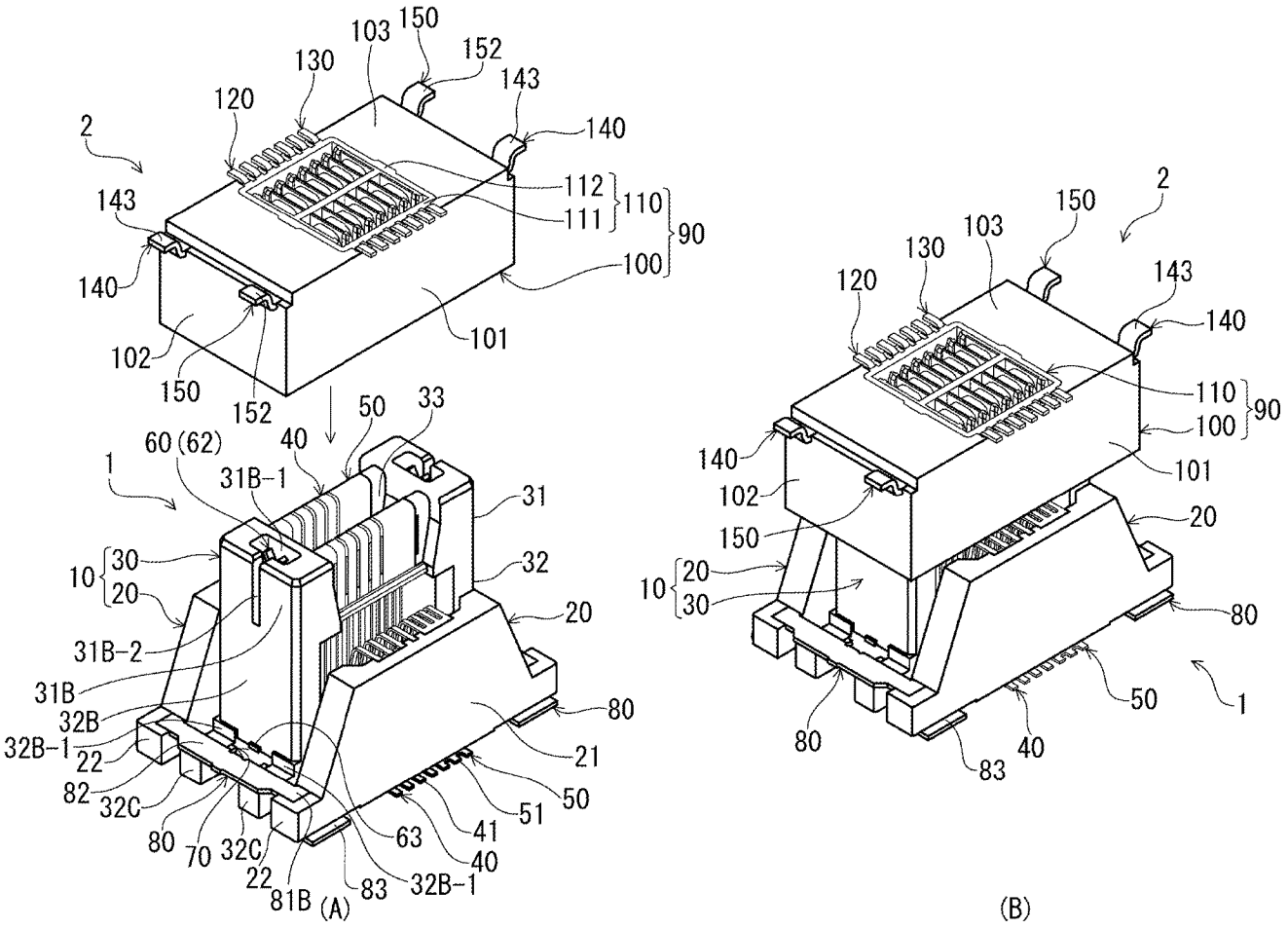
Figure 2B:
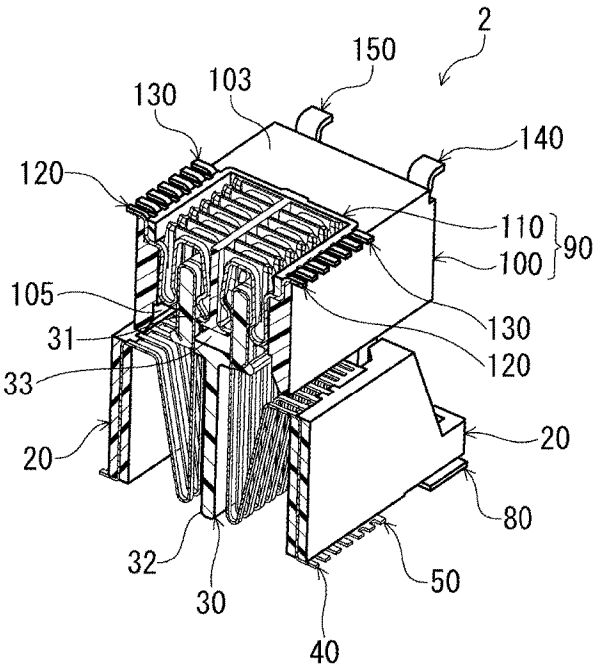
Figure 2A:
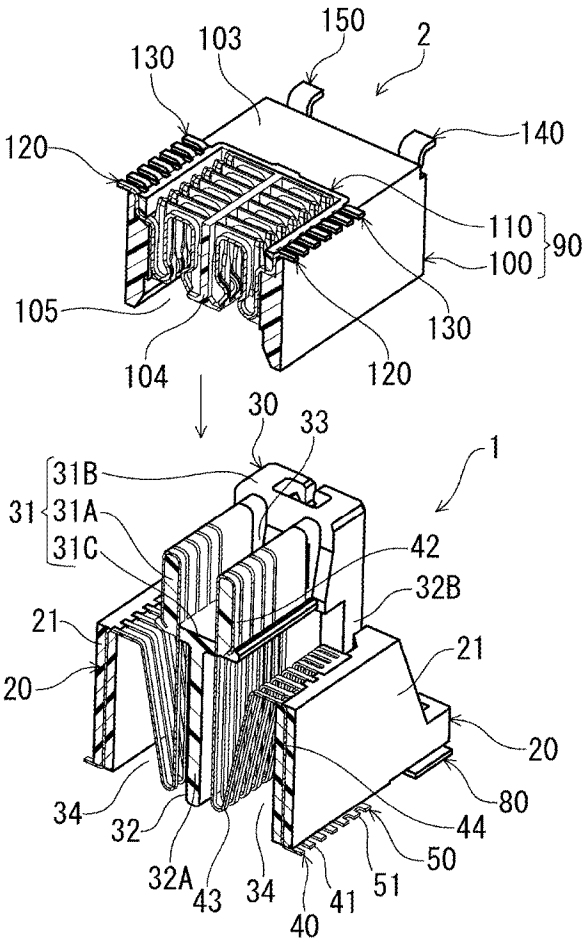
Figure 3:
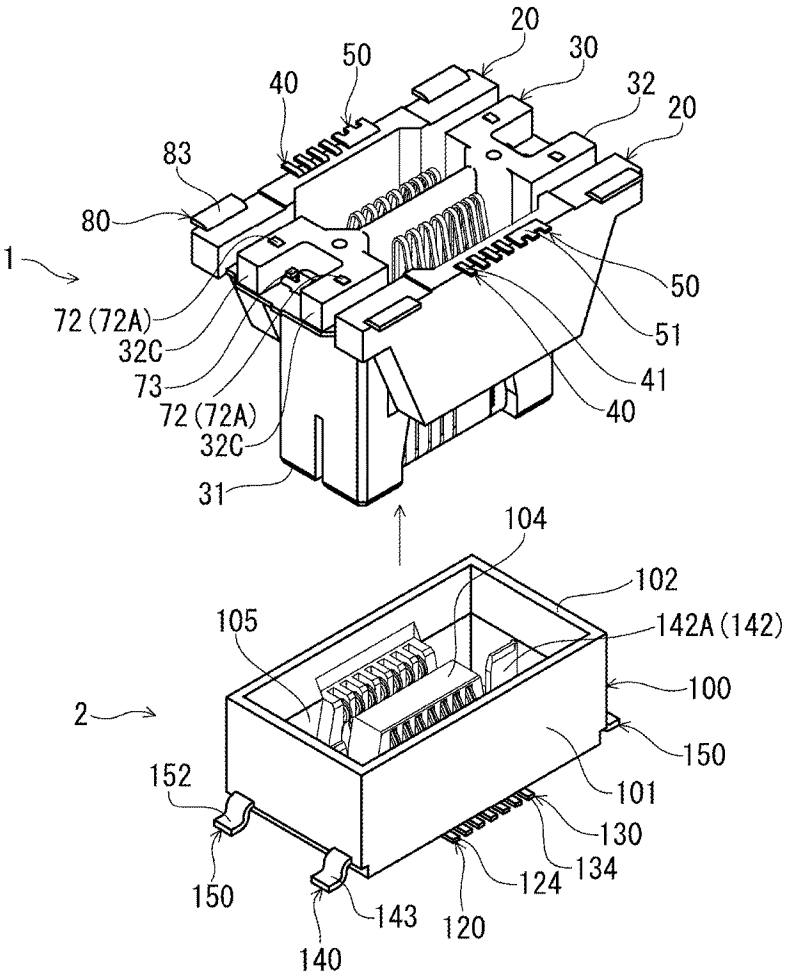
FIG. 3 illustrates an external perspective view of the connector assembly flipped over relative to FIG. 1(A).
Figure 4:
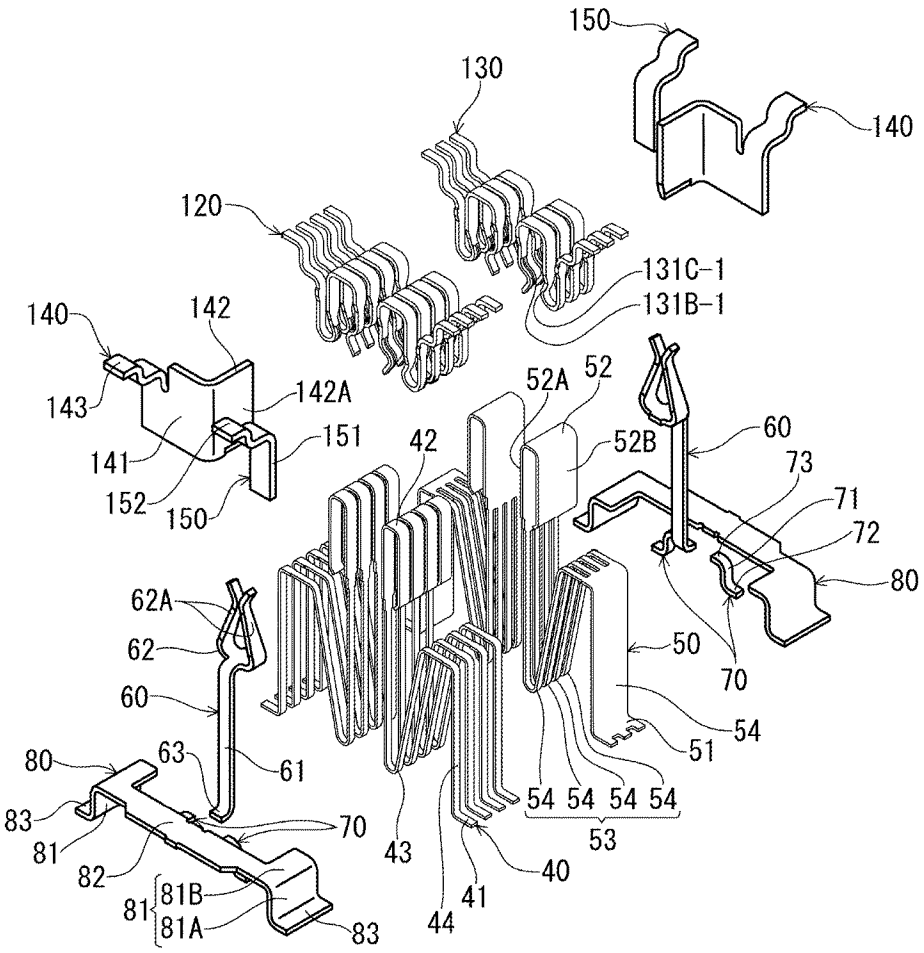
FIG. 4 illustrates an external perspective view wherein the respective housings have been omitted from the two connectors of FIG. 1.

FIGS. 1(A) and 1(B) illustrate an external perspective view of a connector assembly according to an example implementation of the present disclosure, which has a plug connector and a receptacle connector matedly connected thereto, wherein FIG. 1(A) illustrates a state prior to mating connection and FIG. 1(B) illustrates a state subsequent to mating connection. FIGS. 2(A) and 2(B) illustrate a cross-sectional perspective view illustrating the inside of the two connectors of FIGS. 1(A) and 1(B), wherein FIG. 2(A) is a state prior to mating connection corresponding to FIG. 1(A) and FIG. 2(B) is a state subsequent to mating connection corresponding to FIG. 1(B). FIG. 3 is an external perspective view of the connector assembly flipped over relative to FIG. 1(A). FIG. 4 is an external perspective view wherein the respective housings have been removed from the two connectors of FIG. 1(A) and 1(B). For ease of explanation, in the two connectors of FIG. 4, the group of signal terminals, the power supply terminals, and various other fittings are shown in locations produced by substantially increasing their spacing in the direction of the terminal array in comparison with the state in which they are actually provided in the connectors.

In the example implementation described herein, a connector assembly is formed by a plug connector 1 serving as an electrical connector for circuit boards disposed on the mounting face of a connector assembly circuit board (not shown) and a receptacle connector 2 serving as an electrical connector for circuit boards disposed on the mounting face of another circuit board (not shown). The two connectors are inserted and extracted such that the two mounting faces of the first and second circuit boards are arranged in a mutually parallel orientation and the direction perpendicular to the said mounting faces (vertical direction) is the direction of connector insertion and extraction. Specifically, as can be seen in FIGS. 1(A) and 1(B), the receptacle connector 2, which serves as a counterpart connector (counterpart connector component), is matedly connected to the plug connector 1 from above. While in the present example the receptacle connector 2 is assumed to be the counterpart connector of the plug connector 1, the plug connector 1 can also be viewed as the counterpart connector from the standpoint of the receptacle connector 2.

The plug connector 1 has a plug housing 10, which extends such that a direction parallel to the mounting face of the circuit board is its longitudinal direction; plug signal terminals 40 and plug power supply terminals 50 (referred to as the "plug terminals 40, 50" below for brevity when there is no need to distinguish the two), which are arranged and held in place in the plug housing 10 such that said longitudinal direction is the terminal array direction; and retaining fittings 60, abutment fittings 70, and anchor fittings 80, which are held in place in the plug housing 10 on the outside of the terminal array range in the direction of the terminal array. In addition, the plug housing 10 includes stationary housings 20 mounted to the circuit board by means of the plug terminals 40, 50; and a movable housing 30 formed as a member that is separate from said stationary housings 20 and is movable relative to said stationary housings 20.

In this example implementation, the plug connector 1 is made to be symmetrical in the connector width direction, i.e., in a direction parallel to the surface of the circuit board, which is also a transverse direction perpendicular to the above-mentioned longitudinal direction. The stationary housings 20, which are made of an electrically insulating material, are formed in the shape of plates extending in the above-mentioned longitudinal direction as members separate from said movable housing 30 in locations spaced apart from said movable housing 30 on both sides of the lower half of the movable housing 30 in the width direction of the connector, with their major faces disposed at right angles to the connector width direction. The respective stationary housings 20 on both sides of the movable housing 30 are also formed as separate members.

As can be seen in FIGS. 1(A) and 1(B), the stationary housings 20 have planar middle portions 21, which extend in the direction of the terminal array through a range encompassing the movable housing 30 and face the lateral sides of said movable housing 30; and coupled portions 22, which protrude outwardly in the direction of the terminal array from both ends at the bottom of said middle portions 21. As can be seen in FIGS. 2(A) and 2(B), the middle portions 21 have formed therein stationary-side retaining portions where the hereinafter-described stationary-side retained portions 44, 52 formed at one end of the hereinafter-described plug terminals 40, 50 are held in place via integral molding. In addition, the two stationary housings 20 have their coupled portions 22 connected using the hereinafter-described anchor fittings 80 at both ends in the direction of the terminal array.

Figure 5B:
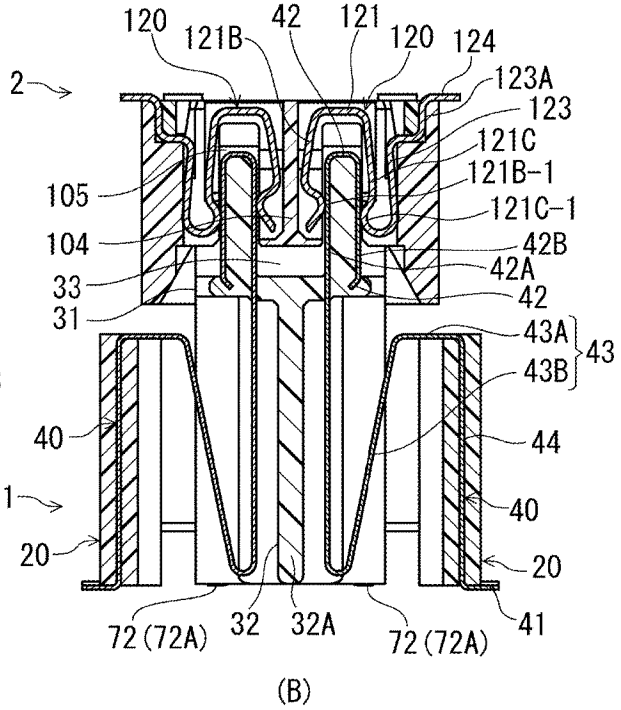
Figure 5A:
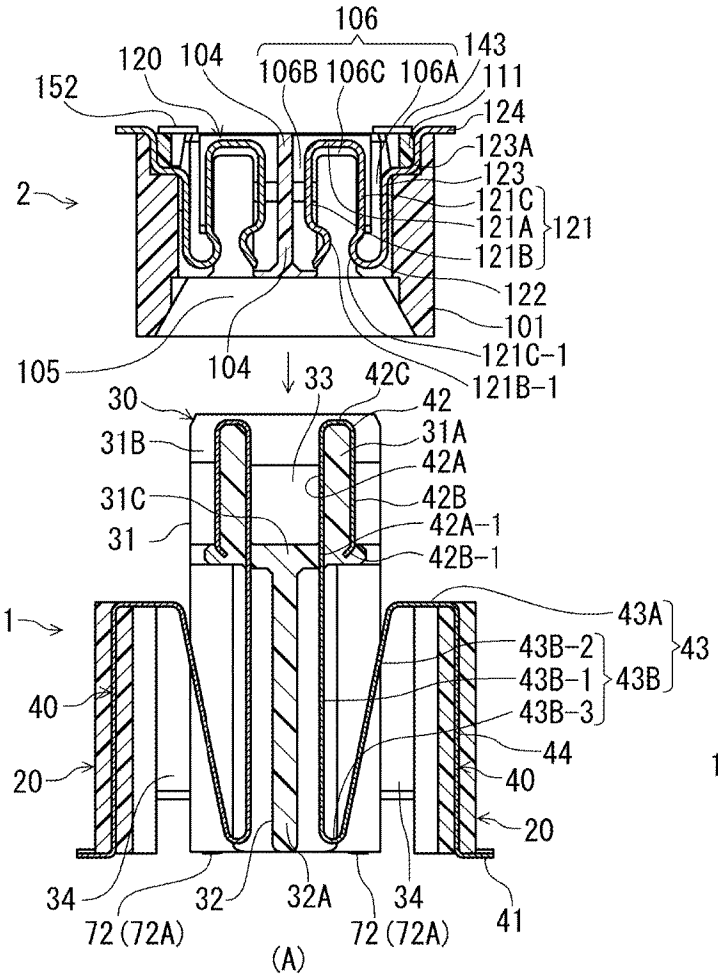

As can be seen in FIGS. 2(A) and 2(B), the movable housing 30 is made of an electrically insulating material in the same manner as the stationary housings 20 and has a mating portion 31, which forms the upper half, and a stay portion 32, which forms the lower half (see also FIGS. 5(A) and 5(B)).

In FIGS. 2(A) and 2(B), the mating portion 31 has an upwardly open closed-bottomed polygonal tubular configuration and has a receiving portion 33, which is a concave space for receiving the receptacle connector 2 and which is formed by a bottom wall 31C and by peripheral walls made up of side walls 31A and end walls 31B. Furthermore, said mating portion 31, in addition to having the plug terminals 40, 50 held in place on the bottom wall 31C and on the inner lateral faces, upper faces, and outer lateral faces of the side walls 31A extending in the direction of the terminal array, receives the receptacle connector 2 in the receiving portion 33 and electrically connects receptacle terminals 120, 130 provided in said receptacle connector 2 with the plug terminals 40, 50 by bringing them into contact.

As can be seen in FIG. 1(A), end bore portions, which are upwardly open and extend in the vertical direction throughout almost the entire length of the end walls 31B, are formed in said end walls 31B. Said end bore portions 31B-1 receive the hereinafter-described retaining portions 62 of the retaining fittings 60 (see also FIGS. 6(A) and 6(B)). In addition, end groove portions 31B-2 extending in the vertical direction throughout almost the entire length of said end walls 31B are formed in the end walls 31B at locations that are outboard of the end bore portions 31B-1 in the direction of the terminal array and are positioned at the mid-width of the connector. Said end groove portions 31B-2, along with being upwardly open, pass through in the direction of the terminal array (in the wall thickness direction of the end walls 31B), as a result of which the end bore portions 31B-1 are placed in communication with the outside environment in the direction of the terminal array via the end groove portions 31B-2.

As can be seen in FIG. 2(A), the stay portion 32 of the movable housing 30 has a vertical central wall portion 32A, which extends downwardly from the bottom wall 31C of the above-mentioned mating portion 31 at a mid-width location of the connector and, in the direction of the terminal array, extends throughout the entire length of the receiving portion 33 in the direction of the terminal array; and vertical end wall portions 32B, which are provided as a single piece with said vertical central wall portion 32A at both ends of said vertical central wall portion 32A in the direction of the terminal array and extend in the connector width direction. Lateral open spaces 34, which expand laterally from the vertical central wall portion 32A all the way to the stationary housings 20 positioned outboard of the receiving portion 33 in the connector width direction, are formed in this movable housing 30 by the vertical central wall portion 32A and the vertical end wall portions 32B of the above-mentioned stay portion 32 under the bottom wall 31C. As can be seen in FIG. 1(A), protruding portions 32B-1 protruding directly above the hereinafter-described restricted portions 32C from the end faces (faces perpendicular to the terminal array direction) of the vertical end wall portions 32B are formed at locations proximal to both ends in the connector width direction at the bottom of the vertical end wall portions 32B. Said protruding portions 32B-1 are located on both sides of the edge overhang portion 63 of the hereinafter-described retaining fittings 60, and their protruding top surfaces are located slightly outwardly of the edge overhang portion 63 in the direction of the terminal array (see also FIG. 7(D)).

As can be seen in FIG. 1(A), restricted portions 32C, which project outwardly in the direction of the terminal array, are provided at the lower ends of the vertical end wall portions 32B in locations proximal to both ends in the connector width direction. The two restricted portions 32C are located under the hereinafter-described coupling portion 82 of the anchor fitting 80 coupling the two stationary housings 20; and the upper faces of said restricted portions 32C are opposed to the lower face of said coupling portion 82 in close proximity thereto, such that when the movable housing 30 moves upwardly in excess of a permissible limit, said restricted portions 32C abut the coupling portion 82 and its movement is restricted.

Although the stay portion 32 extends downwardly from the bottom wall 31C of the mating portion 31, in which the receiving portion 33 is formed, to the vicinity of the surface of the circuit board, it is not secured to said circuit board, such that the entire movable housing 30 is movable in the width direction, length direction, and vertical direction of the connector when acted upon by external forces.

As can be seen in FIGS. 1(A) and 1(B), in the plug connector 1, the plug terminals 40, 50 are arranged in two rows with multiple (four in the present example implementations) plug signal terminals 40 and a single plug power supply terminal 50 adjacent to said plug signal terminals 40 disposed in each row at equal intervals.

As can be seen in FIGS. 2(A) and 2(B), FIG. 4, and FIGS. 5(A) and 5(B), the plug signal terminals 40 have a strip-like configuration throughout their entire length and, with the exception of the hereinafter-described inverted U-shaped insertion portions 42, are made by bending narrow flat metal strip-like pieces of equal width in the through-thickness direction thereof. The inverted U-shaped insertion portions 42 are slightly wider than the other portions. Accordingly, the dimension in the direction perpendicular to the through-thickness direction (terminal array direction) is the terminal width. When the plug connector 1 is viewed in the direction of the terminal array, the plug signal terminals 40 have a laterally substantially S-shaped signal-type resilient portion 43 positioned between a signal-type connecting portion 41 formed at one end located below, and an inverted U-shaped insertion portion 42 formed at the other end located above. Said plug signal terminals 40 are provided in pairs symmetrical in the connector width direction, with multiple pairs arranged in the direction of the terminal array.

The signal-type connecting portions 41 extend outwardly in the connector width direction so as to be located on the upper face of the circuit board. In addition, the plug signal terminals 40 have stationary-side retained portions 44 that are bent in the sections adjacent to said signal-type connecting portions 41 and extend upwardly. Said stationary-side retained portions 44 are embedded in the stationary housings 20 and held in place as a result of being molded integrally with said stationary housings 20. In other words, the stationary housings 20 have formed therein stationary-side retaining portions for the stationary-side retained portions 44. The above-mentioned signal-type connecting portions 41 are located below the bottom faces of the stationary housings 20 and extend outwardly in the connector width direction along said bottom faces.

On the other hand, the inverted U-shaped insertion portions 42, which are located higher than the stationary-side retained portions 44, extend in an inverted U-shaped configuration along the inner lateral faces, upper faces, and outer lateral faces of the side walls 31A of the movable housing 30 and maintain surface contact with said inner lateral faces, upper faces, and outer lateral faces. As can be seen in FIG. 5(A), two arm portions extending in the vertical direction of said inverted U-shaped insertion portions 42, in other words, inner arm portions extending along the above-mentioned inner lateral faces and outer arm portions extending along the above-mentioned outer lateral faces, are formed on major faces exposed from the side walls 31A as signal-type inner contact portions 42A and signal-type outer contact portions 42B that are placed in contact with the receptacle signal terminals 120 of the receptacle connector 2. In addition, as can be seen in FIGS. 5(A) and 5(B), the lower ends 42A-1 of the signal-type inner contact portions 42A and the lower ends (free ends) 42B-1 of the signal-type outer contact portions 42B are embedded in the bottom wall 31C of the movable housing 30. In this manner, the inverted U-shaped insertion portions 42 are held in place on the side walls 31A and the bottom wall 31C via integral molding, and said inverted U-shaped insertion portions 42 in their entirety constitute movable-side retained portions.

In addition, the upper end curved portions 42C that couple the upper ends of the signal-type inner contact portions 42A and signal-type outer contact portions 42B are curved convexly upward, and their upper faces and, in particular, the inside upper faces located on the inside in the connector width direction of said upper end curved portions 42C form surfaces at substantially the same level as the upper faces of the above-mentioned side walls 31A, thereby forming guiding lead-in surfaces for the receptacle connector 2.

Since in the present example implementation the inverted U-shaped insertion portions 42 extend along the inner lateral faces, upper faces, and outer lateral faces of the side walls 31A in surface contact with said inner lateral faces, upper faces, and outer lateral faces, when the connectors are in a mated state, the signal-type inner contact portions 42A and signal-type outer contact portions 42B can be sufficiently resistant to contact pressure during contact with the receptacle signal terminals 120 of the receptacle connector 2.

As can be seen in FIG. 5(A), the signal-type resilient portions 43 are generally of a substantially laterally S-shaped configuration and have a horizontal resilient portion 43A, which extends in a rectilinear manner inwardly in the connector width direction from said stationary-side retained portion 44 at the level of the upper ends of the stationary housings 20; and a substantially U-shaped curved resilient portion 43B, which is located inwardly of the horizontal resilient portion 43A in the connector width direction, that is, closer to the movable housing 30, and which couples said horizontal resilient portion 43A with the signal-type inner contact portion 42A. The curved resilient portion 43B has an inner rectilinear portion 43B-1, which extends in a rectilinear manner downwardly from the lower end 42A-1 of the signal-type inner contact portion 42A; an outer rectilinear portion 43B-2, which is bent at the inner end of the horizontal resilient portion 43A in the connector width direction and extends obliquely downward; and a lower end curved portion 43B-3, which is curved convexly downward and couples the lower ends of the inner rectilinear portion 43B-1 and outer rectilinear portion 43B-2.

The horizontal resilient portion 43A, which is capable of resilient displacement in the vertical direction, resiliently flexes in response to vertical movement of the movable housing 30. Accordingly, when the movable housing 30 is mated with the receptacle connector 2 in the receiving portion 33 and the movable housing 30 is positioned with an offset relative to the stationary housings 20, for example, relative to the normal position in the vertical direction, the above-mentioned offset is absorbed by the resilient displacement of the above-mentioned horizontal resilient portions 43A in the vertical direction, resulting in so-called floating. In addition, since in the present example implementation the horizontal resilient portions 43A are at the same level as the upper ends of the stationary housings 20 in the vertical direction and do not protrude upwardly above the stationary housings 20, the risk of a finger or another external object touching said horizontal resilient portions 43A can be made extremely low.

While in the present example implementation the horizontal resilient portions 43A are designed to extend parallel to the mounting face of the circuit board, they do not necessarily have to be parallel to said mounting face and may extend at an angle with respect to said mounting face. In other words, it is sufficient for the horizontal resilient portions 43A to extend such that some element thereof is parallel to the mounting face of the circuit board. In addition, while in the present example implementation the horizontal resilient portions 43A are designed to be parallel to the mounting face throughout their entire length, as an alternative, for example, a longitudinally intermediate portion of the horizontal resilient portions may be bent such that only part thereof in said longitudinal direction is made parallel to the mounting face while other parts may be inclined with respect to the mounting face. In addition, while in the present example implementation the horizontal resilient portions 43A are at the same level as the upper ends of the stationary housings 20, as an alternative, they may be provided, for example, in locations that are somewhat lower than the upper ends of the stationary housings 20, i.e., in locations proximal to the upper ends (top portion locations).

As can be appreciated from FIGS. 5(A) and 5(B), the above-mentioned curved resilient portions 43B are substantially contained within the above-mentioned lateral open spaces 34 of the movable housing 30. Although the inner rectilinear portions 43B-1 of said curved resilient portions 43B extend along the vertical central wall portion 32A, which forms part of the stay portion 32 of the movable housing 30, they are spaced apart from said vertical central wall portion 32A in the connector width direction. In this manner, when the plug signal terminals 40 are acted upon by external forces, resilient displacement (resilient deformation) becomes possible in the above-mentioned lateral open spaces 34 in the connector width direction. Therefore, when the movable housing 30 is mated with receptacle connector 2 in the receiving portion 33 and the movable housing 30 is positioned with an offset relative to the stationary housings 20, for example, relative to the normal position in the connector width direction, the above-mentioned offset is absorbed by the resilient displacement of the above-mentioned curved resilient portions 43B and so-called floating occurs. If the offset of the above-mentioned movable housing 30 is, for example, in the rightward direction in FIGS. 6(A) and 6(B), the resilient displacement occurs such that the curved resilient portions 43B of the right-side plug signal terminals 40 are compressed in a side-to-side direction and the curved resilient portions 43B of the left-side plug signal terminals 40 are expanded in the same direction.

In the present example implementation, the horizontal resilient portions 43A of the plug signal terminals 40 extend from the stationary-side retained portions 44 (at the level of the upper ends of the stationary housings 20) inwardly in the connector width direction parallel to the surface of the circuit board. In other words, the horizontal resilient portions 43A are positioned separately from the movable housing 30 in the connector width direction. Accordingly, the horizontal resilient portions 43A undergo considerable resilient flexure in response to the vertical movement of the movable housing 30. As a result, the amount of offset that can be absorbed in the vertical direction increases.

In addition, while the curved resilient portions 43B are more proximal to the movable housing 30 in the connector width direction than the horizontal resilient portions 43A, the amount of resilient flexure of said curved resilient portions 43B in directions parallel to the surface of the circuit board (in the connector width direction and in the terminal array direction) is determined by the dimensions of said curved resilient portions 43B in the vertical direction and does not vary depending on position in the connector width direction. Therefore, the amount of offset that can be absorbed by the curved resilient portions 43B in directions parallel to the surface of the circuit board is ensured without being affected by the position of the curved resilient portions 43B.

In addition, since in the present example implementation the curved resilient portions 43B are located below the inverted U-shaped insertion portions 42, the flexible arm length (dimensions in the vertical direction) of the curved resilient portions can be configured to be longer, and, therefore, the amount of resilient deformation of the curved resilient portions 43B in directions parallel to the surface of the circuit board can be increased.

As can be best seen in FIG. 4, the plug power supply terminals 50 are of a strip-like configuration throughout their entire length and are made by bending flat metal strip-like pieces of substantially uniform width in the through-thickness direction. When viewed in the terminal array direction, said plug power supply terminals 50 are of the same configuration as the plug signal terminals 40 and are disposed at the same level. As can be seen in FIG. 4, while being configured identically to the plug signal terminals 40 in some other respects, said plug power supply terminals 50 are configured differently from the plug signal terminals 40 in that they are formed such that their dimensions in the terminal array direction (width dimension) are larger than those of the plug signal terminals 40 and in that the hereinafter-described power supply-type resilient portions 53 are divided into multiple narrow resilient portions. In the present example implementation, the plug power supply terminals 50 are discussed with emphasis on differences from the plug signal terminals 40 and components common to said plug signal terminals 40 are denoted by like reference numerals obtained by adding "10" to the reference numerals of each component of the plug signal terminals 40 and are not further discussed herein.

Between power supply-type connecting portions 51 and inverted U-shaped insertion portions 52, the plug power supply terminals 50 have power supply-type resilient portions 53 that couple the two. Said power supply-type resilient portions 53, in other words, the horizontal resilient portions 53A and curved resilient portions 53B, are divided into multiple (four in the present disclosure) narrow resilient portions 54 with the help of slits formed in multiple locations in the terminal array direction. The arrangement pitch dimensions of the multiple narrow resilient portions 54 are all the same and smaller than the arrangement pitch dimensions of the multiple plug signal terminals 40. In addition, the arrangement pitch dimensions of the multiple narrow resilient portions 54 are smaller than the arrangement pitch dimensions of the hereinafter-described receptacle power supply terminals 130 provided in the receptacle connector 2. The portions that are divided in the plug power supply terminals 50 are the power supply-type resilient portions 53, in other words, in the plug power supply terminals 50 parts other than the narrow resilient portions 54 of the power supply-type resilient portions 53 are continuous in the terminal array direction and constitute a single member.

Although in the present example implementation all the arrangement pitch dimensions of the multiple narrow resilient portions 54 are designed to be the same, as an alternative, the arrangement pitch dimensions may be different for some or all of the multiple narrow resilient portions 54. In addition, although in the present example implementation adjacent narrow resilient portions 54 are designed to be spaced apart from each other throughout their entire extent in the longitudinal direction, as an alternative, they may be partly interconnected in said longitudinal direction.

In the present example implementation, the spacing of the pairs of multiple narrow resilient portions 54 in the power supply-type resilient portions 53 is narrower than the gaps between the pairs of signal-type resilient portions 43 in the multiple plug signal terminals, and it is therefore possible to correspondingly increase the number of the narrow resilient portions 54 or make the cross-sectional area of each narrow resilient portion 54 larger. As a result, the cross-sectional area of the power supply-type resilient portions 53, in other words, the total cross-sectional area of the multiple narrow resilient portions 54, is increased, thus making it possible to pass a larger current that is proportional to the amount of the increase. Moreover, as a result of reducing the arrangement pitch dimensions of the narrow resilient portions 54, the width of each narrow resilient portion 54 can also be reduced and a resilience equal to or greater than that of the signal-type resilient portions 43 can be ensured in the power supply-type resilient portions 53.

Further, since in the present example implementation the inverted U-shaped insertion portions 52 are not divided in the terminal array direction and the power supply-type inner contact portions 52A and power supply-type outer contact portions 52B of the inverted U-shaped insertion portions 52 have a single surface of contact extending in a continuous manner in the terminal array direction, a larger current can be passed by increasing the number of the narrow resilient portions 54 or by expanding the cross-sectional area of each narrow resilient portion 54 regardless of the arrangement pitch dimensions of the plug signal terminals 40. In addition, the number of the hereinafter-described receptacle power supply terminals 130, which serve as counterpart terminals, can be selected regardless of the number of the narrow resilient portions 54 and, furthermore, high resilience can be ensured regardless of the number of the receptacle power supply terminals 130.

In addition, since the plug power supply terminals 50 are of substantially equal width throughout their entire length, even though the width dimensions (dimensions in the terminal array direction) of the plug power supply terminals 50 are not locally increased, their width dimensions can be generally kept to a minimum and their width can be efficiently used and, furthermore, the resilience of the power supply-type resilient portions 53 can be ensured.

Furthermore, since the plug power supply terminals 50 are of the same configuration as the above-mentioned signal terminals when viewed in the terminal array direction, the same fittings can be used to bend the plug signal terminals 40 and the plug power supply terminals 50 when the plug connector 1 is manufactured. In addition, since the plug power supply terminals 50 are arranged at the same level as the above-mentioned signal terminals when viewed in the terminal array direction, the signal-type resilient portions 43 and power supply-type resilient portions 53 are in the same plane when viewed in the direction of the terminal array and, as a result, in the entire plug connector 1, the resilient flexural deformation used for floating in the plug signal terminals 40 and the plug power supply terminals 50 can be more easily generated.

Figure 6B:
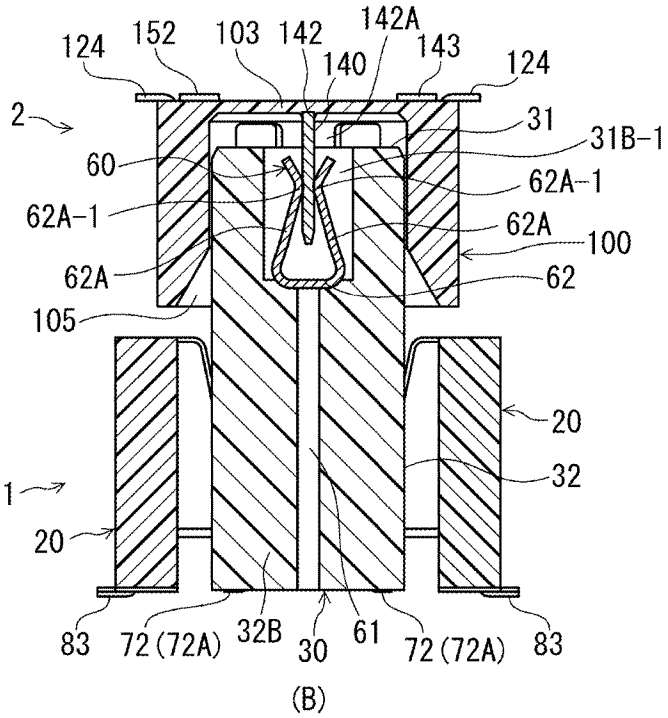
Figure 6A:
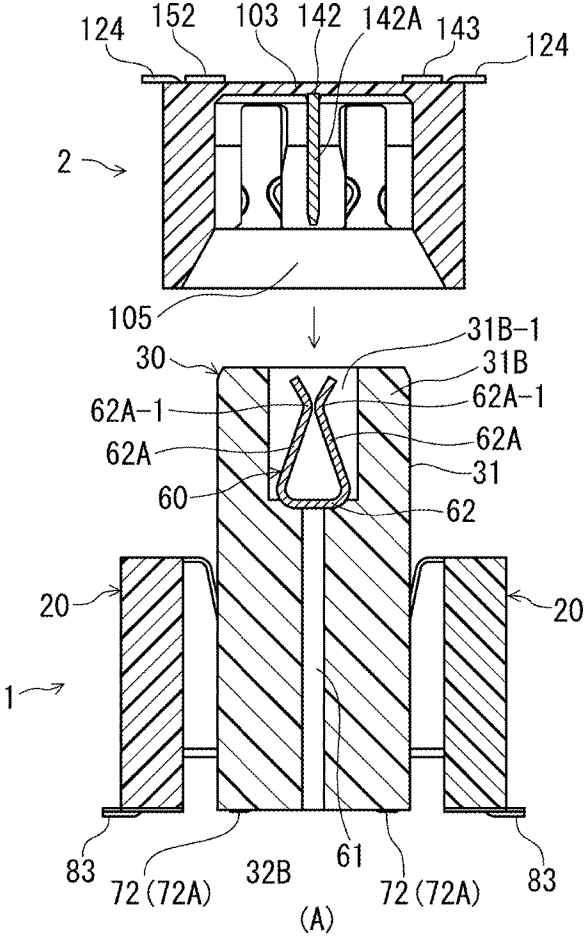

As can be seen in FIG. 4 and FIGS. 6(A) and 6(B), the retaining fittings 60, which are formed by bending a sheet metal member in the through-thickness direction, have a mounting portion 61, which extends rectilinearly in the vertical direction and is fixedly attached to the movable housing 30, a substantially U-shaped retaining portion 62, which is coupled to the upper end of said mounting portion 61 and which clamps and holds the retained plate portion 142A of the hereinafter-described retained fitting 140 of the receptacle connector 2, and an edge overhang portion 63, which is obtained by bending the lower end of said mounting portion 61 outwardly in the terminal array direction and such that it protrudes from the movable housing 30. Said retaining fittings 60 function as reinforcing fittings that are held in place as a result of being molded integrally with the movable housing 30 and that reinforce said movable housing 30.

As can be seen in FIGS. 6(A) and 6(B), the mounting portions 61, which are embedded in and extend through the vertical end wall portions 32B of the movable housing 30 in the vertical direction, are fixedly attached to said vertical end wall portions 32B via integral molding with said vertical end wall portions 32B. As can be seen in FIG. 4, the upper ends of the mounting portions 61 are bent inwardly in the direction of the terminal array and are coupled to the bottoms of the retaining portions 62. In other words, said retaining portions 62 are located more inwardly in the terminal array direction than the mounting portions 61.

The retaining portions 62 have a pair of resilient clamping pieces 62A resiliently displaceable in the connector width direction, which extend upward and have their major faces opposed in said connector width direction. As can be seen in FIGS. 6(A) and 6(B), in locations proximal to the upper ends of said resilient clamping pieces 62A, said pair of resilient clamping pieces 62A have clamping portions 62A-1, which are configured to clamp and hold the retained plate portions 142A of the receptacle connector 2 in the connector width direction (through-thickness direction of said retained plate portion 142A). Specifically, the pair of resilient clamping pieces 62A, which are inclined inwardly in the connector width direction so as to approach each other as one moves in the upward direction, form the above-mentioned clamping portions 62A-1 (see FIGS. 6(A) and 6(B)) that protrude inwardly in the connector width direction in locations proximal to the upper ends of the said resilient clamping pieces 62A, and then, as one moves further in the upward direction, become inclined outwardly in the connector width direction so as to move away from each other. As can be seen in FIG. 6(B), when the connectors are in a mated state, said pair of resilient clamping pieces 62A clamp and hold the retained plate portions 142A of the receptacle connector 2, thereby maintaining the location of contact between the plug terminals 40, 50 and the receptacle terminals 120, 130 provided in said receptacle connector 2.

Figure 7A:
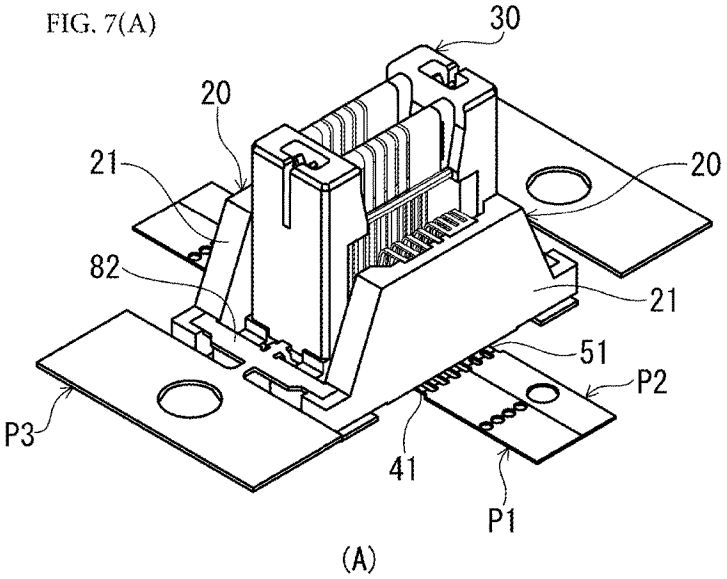
FIG. 7(A) is an external perspective view illustrating a plug connector in the process of manufacture.
Figure 7B:
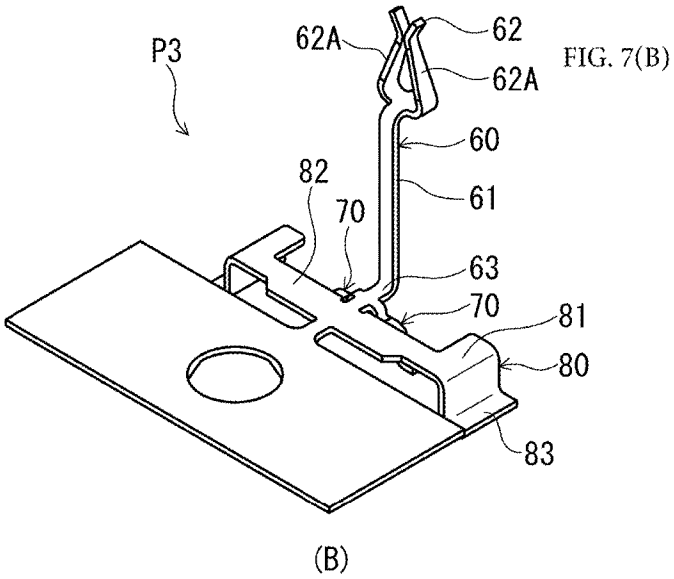
FIG. 7(B) is an external perspective view illustrating a single carrier-equipped reinforcing fitting blank.
Figure 7C:
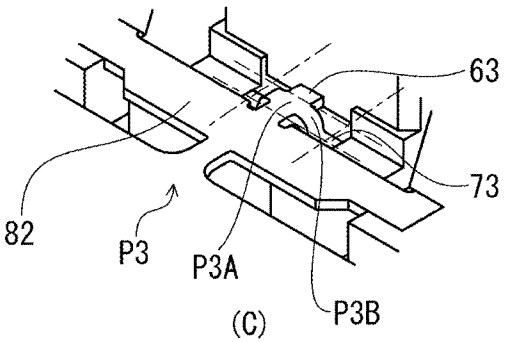
FIG. 7(C) is an enlarged view of a coupling portion of the retaining fitting and anchor fitting in the reinforcing fitting blank of FIG. 7(A)
Figure 7D:
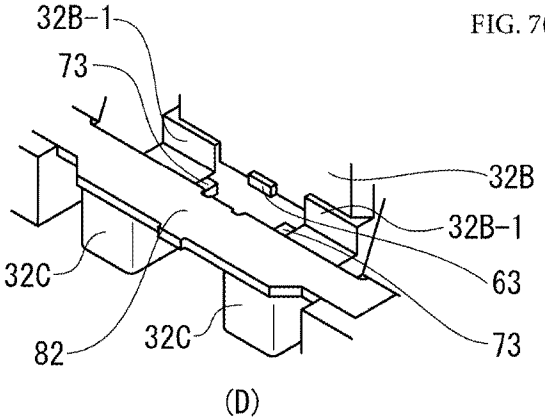
FIG. 7(D) is an enlarged view illustrating a state in which the coupling portion of FIG. 7(C) has been removed.

As can be seen in FIGS. 1(A) and 1(B), the edge overhang portion 63 protrudes from the bottom end face (face perpendicular to the direction of the terminal array) of the vertical end wall portion 32B of the movable housing 30 and is located in a space formed between the two restricted portions 32C of the movable housing 30 in the connector width direction (see also FIG. 7(D)).

As can be seen in FIG. 4, the abutment fittings 70 are located below the retaining fitting 60 and outwardly in the terminal array direction, with one abutment fitting provided on each side of the retaining fitting 60 in the connector width direction. Said abutment fittings 70, which are formed by bending a strip-shaped sheet metal member in the through-thickness direction in a crank-shaped configuration, have embedded portions 71, which are of an inverted L-shaped configuration when viewed in the direction of the terminal array and which are embedded and held in place in the restricted portions 32C of the movable housing 30; abutment portions 72, which are bent at the lower ends of said embedded portions 71 and extend outwardly in the connector width direction; and lateral overhang portions 73, which extend inwardly in the connector width direction as a continuation of the upper ends (ends oriented inwardly in the connector width direction) of the embedded portions 71. Said abutment fittings 70 similarly function as reinforcing fittings which, as a result of being held in place in the restricted portions 32C of the movable housing 30 in this manner, reinforce said movable housing 30.

As can be seen in FIG. 3, in the abutment portions 72, the bottom (top in FIG. 3) of said abutment portions 72 is exposed as a result of slightly protruding from the bottom faces (upper faces in FIG. 3) of the restricted portions 32C. The lower faces (upper faces in FIG. 3) of the abutment portions 72 exposed from the bottom faces of said restricted portions 32C constitute abutment surfaces 72A abuttable against the surface of the circuit board when the movable housing 30 moves downwardly (upwardly in FIG. 3) towards the circuit board. The lateral overhang portions 73 protrude in the connector width direction from the inner lateral faces of the top portions of the restricted portions 32C at locations below the edge overhang portion 63 and are located in the space formed between the two restricted portions 32C of the movable housing 30 in the connector width direction (see also FIG. 7(D)).

Due to the fact that in the present example implementation the abutment surfaces 72A of the abutment portions 72 of the abutment fittings 70 are positioned so as to be exposed on the bottom face of the movable housing 30, it is not the movable housing 30 but the abutment surfaces 72A of the abutment fittings 70 that abut the circuit board when the receptacle connector 2 is pushed into the movable housing 30 with a substantial force. Therefore, the movable housing 30 itself never abuts the circuit board and, as a result, damage to said movable housing 30 is prevented. In addition, since in the present example implementation the abutment surface 72A of the above-mentioned abutment portions 72 is a major face (rolled surface) of the sheet metal member, when the movable housing 30 moves in a direction parallel to the circuit board and absorbs offset in the same direction, the abutment portions 72 can be smoothly placed in sliding contact with the surface of the circuit board.

As can be seen in FIG. 1(A) and FIG. 4, the anchor fittings 80 are positioned throughout a range overlapping with the retaining fittings 60 and abutment fittings 70 in the terminal array direction. Said anchor fittings 80, which are formed by bending a sheet metal member in the through-thickness direction, have embedded portions 81, which are bent so as to be of an inverted L-shaped configuration when viewed in the direction of the terminal array and which are embedded and held in place in the stationary housings 20; coupling portions 82 serving as exposed portions which, while being exposed from said stationary housings 20, extend in the connector width direction and couple pairs of embedded portions 81; and anchoring portions 83, which are bent at the lower end of each embedded portion 81 and extend outwardly in the connector width direction. The anchor fittings 80 similarly function as reinforcing fittings which, as a result of being held in place in the coupled portions 22 of the stationary housings 20 in this manner, reinforce said stationary housings 20.

As can be seen in FIG. 4, the embedded portions 81 have vertical plate portions 81A, which have a major face perpendicular to the connector width direction, and horizontal plate portions 81B, which are obtained by bending at the top edges of said vertical plate portions 81A and extend inwardly in the connector width direction. The vertical plate portions 81A are entirely embedded in the coupled portions 22 of the stationary housings 20. As can be seen in FIG. 1(A), while the horizontal plate portions 81B have their upper faces positioned at substantially the same height as the upper faces of the coupled portions 22, with the inner portions (inner half portions) in the terminal array direction embedded in the middle portions 21 of the stationary housings 20, the outer portions (outer half portions) in the terminal array direction are embedded in said coupled portions 22 such that their upper faces are exposed from the upper faces of the coupled portions 22.

In addition, as can be seen in FIG. 1(A), the coupling portion 82 has a major face perpendicular to the vertical direction and couples the above-mentioned two outer half portions of the horizontal plate portions 81B of the embedded portions 81. The upper face of said coupling portion 82 is located at substantially the same height as the upper faces of the coupled portions 22. In addition, said coupling portion 82 is located at the same height as the edge overhang portion 63 of the retaining fitting 60. The anchoring portions 83 are located at the same height as the connecting portions 41, 51 of the plug terminals 40, 50 below the bottom faces of the stationary housings 20 and are secured to the corresponding portions of the circuit board using solder connections.

Along with coupling the two stationary housings 20, the thus configured anchor fittings 80 anchor these stationary housings 20 to said circuit board as a result of being solder-connected to the circuit board by the anchoring portions 83.

The steps involved in the manufacture of the plug connector 1 will be described next with reference to FIGS. 7(A) to 7(D). First, in a mold (not shown), a carrier-equipped plug signal terminal blank P1 (see FIG. 7(A)) and a carrier-equipped plug power supply terminal blank P2 (see FIG. 7(A)) are arranged in the direction of the terminal array, and carrier-equipped reinforcing fitting blanks P3 (see FIG. 7(A) and 7(B)), in which the retaining fittings 60, abutment fittings 70, and anchor fittings 80 are formed as a single piece, are placed outboard of the plug terminal blanks P1, P2 in the terminal array direction. If necessary, the plug signal terminal blank P1 and the plug power supply terminal blank P2 are herein collectively referred to as "plug terminal blanks P1, P2".

As can be seen in FIG. 7(A), in the plug terminal blanks P1, P2, the carriers are coupled to the connecting portions 41, 51. As can be seen in FIGS. 7(A) and 7(B), in the reinforcing fitting blank P3, the carrier is coupled to the outer edge of the coupling portion 82 of the anchor fitting 80 (of the two side edges extending in the connector width direction, the side edge located outwardly in the terminal array direction). In addition, as can be seen in FIG. 7(C), in the reinforcing fitting blank P3, the edge overhang portion 63 of the retaining fitting 60, the lateral overhang portions 73 of the abutment fittings 70, and the inner edge of the coupling portion 82 of the anchor fitting 80 are coupled by the coupling section P3A, thereby integrating the retaining fitting 60, abutment fittings 70, and anchor fitting 80 into a single piece. Further, in the vertical direction, the coupling section P3A is located at the same level as the edge overhang portion 63 and coupling portion 82 while being positioned above the lateral overhang portions 73. As can be seen in FIG. 7(C), said coupling section P3A has lateral arm portions P3B extending on both sides thereof in the connector width direction and is coupled to the lateral overhang portions 73 via said lateral arm portions P3B. Said lateral arm portions P3B have formed therein stepped portions with a level difference in the vertical direction, thereby making it possible to couple the coupling portion 82, lateral overhang portions 73, and edge overhang portion 63 of relatively different heights.

Next, once the plug terminal blanks P1, P2 and reinforcing fitting blank P3 are positioned in the mold, a molten electrically insulating material (plastic, etc.) is injected into and solidified in the mold, thereby molding the stationary housings 20 and the movable housing 30. As a result, as can be seen in FIG. 7(A), the plug terminal blanks P1, P2 and reinforcing fitting blank P3 are molded integrally with the movable housing 30 while said reinforcing fitting blank P3 is molded integrally with the stationary housings 20. In this manner, molding the plug terminal blanks P1, P2 and reinforcing fitting blank P3 integrally with the movable housing 30 and the stationary housings 20 makes it possible to achieve excellent accuracy of relative positioning of the movable housing 30 and the stationary housings 20. In addition, while in the present example implementation the stationary housings 20 and the movable housing 30 are configured to be molded simultaneously, as an alternative, they may be molded at different times.

Next, plug terminals 40, 50 are formed by removing the carriers from each of the plug terminal blanks P1, P2. In addition, retaining fittings 60, abutment fittings 70, and anchor fittings 80 are formed by removing the carrier and the coupling section P3A from the reinforcing fitting blank P3. As shown with dashed lines in FIG. 7(C), when the coupling section P3A is removed, said coupling section P3A is removed from the retaining fittings 60 with some material remaining after removal, with the section remaining after removal forming the edge overhang portion 63. In addition, the coupling section P3A has its lateral arm portions P3B cut from the abutment fittings 70 with some material left over after removal, and the sections that remain after removal constitute the lateral overhang portions 73. As a result, as can be seen in FIG. 7(D), the edge overhang portion 63 and the lateral overhang portions 73 are positioned such that they are in close proximity to one another without being in contact.

In addition, since in the present example implementation the two lateral overhang portions 73 of the abutment fittings 70 are located below the coupling portion 82 of the anchor fitting 80, even if the movable housing 30 is moved in a direction parallel to the circuit board, said two lateral overhang portions 73 never abut the coupling portion 82 and, therefore, damage to said lateral overhang portions 73 and coupling portion 82 can be reliably prevented.

In addition, in the present example implementation, the edge overhang portion 63 of the retaining fitting 60 is located at the same height as the coupling portion 82 of the anchor fitting 80. However, as can be seen in FIG. 1(A), protruding portions 32B-1, which protrude from the end face (face perpendicular to the direction of the terminal array) of the vertical end wall portion 32B of the movable housing 30 slightly outward of the edge overhang portion 63 in the terminal array direction, are provided on both sides of the edge overhang portion 63 in the connector width direction. Therefore, even if the movable housing 30 undergoes significant movement towards the coupling portion 82, the above-mentioned protruding portions 32B-1 abut said coupling portion 82 and the edge overhang portion 63 never abuts the coupling portion 82. As a result, damage to the edge overhang portion 63 and coupling portion 82 can be reliably prevented.

In this manner, the removal of the carriers from the plug terminal blanks P1, P2 and the removal of the carrier and coupling section P3A from the reinforcing fitting blank P3 completes the fabrication of the plug connector 1.

In the present example implementation the retaining fittings 60, the abutment fittings 70, and anchor fittings 80 are simultaneously formed as a result of removing the above-mentioned coupling section P3A in a state in which a single metal reinforcing fitting blank P3 is held in place in the stationary housings 20 and in the movable housing 30, thereby ensuring excellent accuracy of relative positioning of the retaining fittings 60, abutment fittings 70, and anchor fittings 80. In addition, since the reinforcing fitting blank P3 is made of metal, the cut surfaces produced are smooth surfaces superior to those produced, for example, when cutting blanks made of a glass fiber-containing plastic, and there is almost no debris from cutting and any cutting debris is easy to handle. In addition, the cutting blade (not shown) does not get damaged and, furthermore, since the cut surfaces of the reinforcing fitting blank P3 are smooth, the dimensional accuracy of the movable-side reinforcing fittings and stationary-side reinforcing fittings is also excellent.

The configuration of the receptacle connector 2 will be described next. As can be seen in FIGS. 1(A) to 3, the receptacle connector 2 has a receptacle housing 90 extending such that a direction parallel to the mounting face of the other circuit board (not shown) is its longitudinal direction (the same direction as the longitudinal direction of the plug connector 1); receptacle signal terminals 120 and receptacle power supply terminals 130 (referred to as "receptacle terminals 120, 130" below for brevity when there is no need to distinguish the two) held in place in array form on the receptacle housing 90 such that said longitudinal direction is the terminal array direction; and retained fittings 140 and anchor fittings 150 held in place in the receptacle housing 90 on both sides of the terminal array range in the terminal array direction.

The receptacle housing 90 is divided into a receiving-side housing 100, which holds the hereinafter-described inverted U-shaped receiving portions 121, 131 of the receptacle terminals 120, 130 and receives the plug connector 1, and a board-side housing 110, which holds receptacle terminals 120, 130 in place in locations more proximal to the hereinafter-described connecting portions 124, 134 than to the above-mentioned inverted U-shaped receiving portions 121, 131 and which is mounted to the above-mentioned other circuit board, with the receiving-side housing 100 and board-side housing 110 molded as a single piece.

The receiving-side housing 100 is made symmetrical in the connector width direction, which is a direction parallel to the surface of the other circuit board and which is a transverse direction perpendicular to the above-mentioned longitudinal direction. As can be seen in FIG. 3, the receiving-side housing 100 is of a generally rectangular parallelepiped-like external configuration and has perimeter walls consisting of side walls 101 and end walls 102, a bottom wall 103 (see FIG. 1(A)), and a center wall 104.

As can be seen in FIG. 3, the center wall 104 extends in the direction of the terminal array at a mid-width location of the connector in the space within the perimeter walls. The rectangular annular spaces between said center wall 104 and the perimeter walls form a mating concave portion 105 that permits insertion of the mating portion 31 of the movable housing 30 of the plug connector 1. Due to the fact that in FIG. 1 and FIG. 2 the receptacle connector 2 is shown in a state in which it is disposed above the plug connector 1 immediately prior to mating with said plug connector 1, the bottom wall 103 is located on top and the mating concave portion 105 opens downwardly.

As can be seen in FIG. 5(A), terminal holding portions 106, which hold the receptacle terminals 120, 130, are formed in the receiving-side housing 100. Said terminal holding portions 106 are of a substantially inverted U-shaped configuration and have outer groove portions 106A formed in the side walls 101, inner groove portions 106B formed in the center wall 104, and bottom groove portions 106C are formed in the bottom wall 103 so as to place the outer groove portions 106A and the inner groove portions 106B in communication.

Figure 8B:
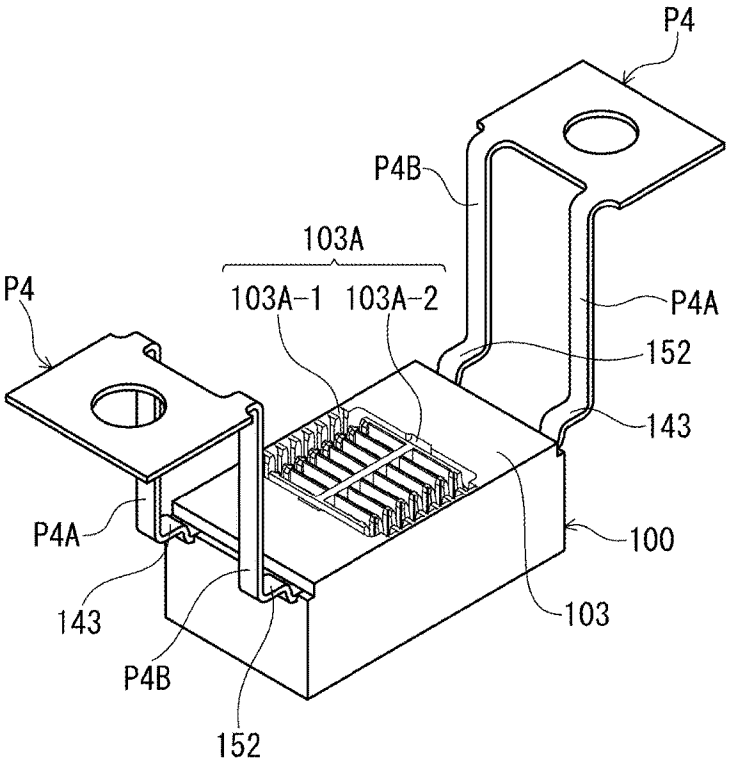

In addition, as can be seen in FIG. 8(B), a bottom recessed portion 103A recessed into the bottom face of said bottom wall 103 in a square frame configuration is formed in the bottom wall 103 of the receiving-side housing 100. In locations proximal to the two lateral edges in the connector width direction (locations proximal to the outer lateral faces of the side walls 101), said bottom recessed portion 103A has lateral recessed portions 103A-1 that extend throughout the terminal array range in the terminal array direction and end recessed portions 103A-2 that extend between the two ends of said lateral recessed portions 103A-1 in the connector width direction. Said lateral recessed portions 103A-1 are in communication with the outer groove portions 106A formed in the side walls 101.

As can be seen in FIG. 1(A), the board-side housing 110, which is of a square frame-shaped configuration that matches the shape of the bottom recessed portion 103A of the receiving-side housing 100 (see FIG. 8(B)), has two side walls 111 that extend in the direction of the terminal array and end walls 112 that extend in the connector width direction and couple the ends of said two side walls 111. Since the side walls 111 of said board-side housing 110 are accommodated inside the lateral recessed portions 103A-1 of the bottom recessed portion 103A and its end walls 112 are accommodated inside the end recessed portions 103A-2 of the bottom recessed portion 103A, said entire board-side housing 110 is accommodated in the bottom recessed portion 103A. As described hereafter, as a result of being molded integrally with the receiving-side housing 100, said board-side housing 110 is also molded integrally with the receptacle terminals 120, 130, and secures the hereinafter-described retained arm portions 123, 133 of the receptacle terminals 120, 130 in place in the side walls 111.

Since in the present example implementation the receptacle housing 90 is divided into a receiving-side housing 100 and a board-side housing 110, when the height dimension settings of the entire receptacle housing 90 are changed, this can be achieved by changing the height dimension of the above-mentioned board-side housing 110. For example, although in the present example implementation the height dimension of the board-side housing 110 is designed to be sufficient for said entire board-side housing 110 to be accommodated in the bottom recessed portion 103A of the receiving-side housing 100, if an increase in the height dimension of the receptacle housing 90 becomes desirable, this can be easily addressed without changing the receiving-side housing 100 by providing a board-side housing of a different type with a larger height dimension instead of the board-side housing 110 and molding it as a single piece with the receiving-side housing 100.

In addition, since of the two housings, i.e., the receiving-side housing 100 and the board-side housing 110, it is the receiving-side housing 100 that accommodates the contact portions of the receptacle terminals 120, 130, its structure is more complicated and requires a higher level of dimensional accuracy. On the other hand, since merely securing a portion of the receptacle terminals 120, 130 is sufficient, the board-side housing 110 has a simple structure and does not require a high level of dimensional accuracy. Therefore, replacing only the board-side housing 110 with another board-side housing having a different height dimension without changing the receiving-side housing 100, as discussed above, makes it possible to minimize increases in manufacturing costs.

The receptacle signal terminals 120 and receptacle power supply terminals 130 are fabricated with the same shape and are arranged at equal intervals to match the arrangement pitch dimensions of the plug signal terminals 40 in the terminal array direction. In the present example implementation, there are four receptacle signal terminals 120 and three receptacle power supply terminals 130.

As can be seen in FIG. 4, throughout their entire length, the receptacle signal terminals 120 have a strip-like configuration and are made by bending narrow flat metal strip-like pieces in the through-thickness direction thereof. As can be seen in FIGS. 5(A) and 5(B), the receptacle signal terminals 120 have an inverted U-shaped receiving portion 121 contained in a terminal holding portion 106 in the receiving-side housing 100; a transitional portion 122, which is coupled to the lower end of the hereinafter-described signal-type outer arm portion 121C, i.e., one of the two arm portions extending in the vertical direction of said inverted U-shaped receiving portion 121, and which is bent so as to fold back upwardly; a retained arm portion 123, which is located outboard of the signal-type outer arm portion 121C in the connector width direction and which, after traversing the transitional portion 122 and extending upwardly in a rectilinear manner, extends in a crank-shaped configuration; and a signal-type connecting portion 124, which is bent at the upper end of said retained arm portion 123 and extends outwardly in the connector width direction.

The inverted U-shaped receiving portions 121 have a base portion 121A, which extends in the connector width direction within the bottom groove portion 106C; a signal-type inner arm portion 121B, which extends downwardly from the inward end of said base portion 121A in the connector width direction through the inner groove portion 106B; and a signal-type outer arm portion 121C, which extends downwardly from the outboard end of said base portion 121A in the connector width direction through the outer groove portion 106A and is coupled to the above-mentioned transitional portion 122. The signal-type inner arm portion 121B and signal-type outer arm portion 121C are capable of resilient displacement in the respective through-thickness direction (connector width direction).

The signal-type inner arm portion 121B has a signal-type inner contact portion 121B-1 that is curved convexly outward in the connector width direction at a location proximal to its lower end. The signal-type outer arm portion 121C has a signal-type outer contact portion 121C-1 that is curved convexly inward in the connector width direction at a location proximal to its lower end (at substantially the same level in the vertical direction as the signal-type inner contact portion 121B-1). The signal-type inner contact portion 121B-1 and the signal-type outer contact portion 121C-1 both have curved apex portions that protrude from the inner groove portions 106B and the outer groove portions 106A and are located within the mating concave portion 105. As can be seen in FIG. 5(B), as the inverted U-shaped insertion portions 42 of the plug connector 1 are inserted from below into the inverted U-shaped receiving portions 121 when the connectors are in a mated state, said signal-type inner contact portions 121B-1 are brought into contact under contact pressure and placed in electrical communication with the signal-type inner contact portions 42A of the inverted U-shaped insertion portions 42 and said signal-type outer contact portions 121C-1 are brought into contact under contact pressure and placed in electrical communication with the signal-type outer contact portions 42B of the inverted U-shaped insertion portions 42.

As can be seen in FIGS. 5(A) and 5(B), the retained arm portion 123 is positioned across a gap from the signal-type outer arm portion 121C in the connector width direction and is contained within the outer groove portion 106A along with said signal-type outer arm portion 121C. Said retained arm portion 123 has its upper half formed as a crank-shaped crank portion 123A and is held in place as a result of said crank portion 123A being molded integrally with the receptacle housing 90. In addition, the lower half of said retained arm portion 123, which extends in the vertical direction (the section obtained if the crank portion 123A is removed), is capable of resilient displacement in its through-thickness direction (in the connector width direction) (see FIG. 5(B)).

As can be seen in FIGS. 1(A) to FIG. 2(B), and FIGS. 5(A) and 5(B), the signal-type connecting portions 124 extend along the bottom face of the receiving-side housing 100 (upper face in FIGS. 1(A) to FIG. 2(B), and FIGS. 5(A) and 5(B)) and are solder-connected to the signal circuitry of the other circuit board (not shown).

Since, as discussed previously, the receptacle power supply terminals 130 are of the same shape as the receptacle signal terminals 120 and are denoted by like reference numerals obtained by adding "10" to the reference numerals of each component of the receptacle signal terminals 120, and thus their configuration is not further discussed herein. In such instances, it is presumed that the term "signal-type" in the designation of each component would be read as "power supply-type".

In the present example implementation, the three receptacle power supply terminals 130 provided in the receptacle connector 2 are positioned such that they correspond to a single plug power supply terminal 50 of the plug connector 1 (see FIG. 4), and the power supply-type contact portions 131B-1, 131C-1 of these three receptacle power supply terminals 130 are placed in contact with the power supply-type contact portions 52A, 52B of said single plug power supply terminal 50.

As can be seen in FIG. 1(A), a single retained fitting 140 is held in place via integral molding at each end of the receptacle connector 2 in the terminal array direction, and, as can be seen in FIG. 4, the retained fitting 140 located at one end and the retained fitting 140 located at the other end are provided so as to be mutually offset from a central position in the connector width direction of the receptacle connector 2. In addition, these two retained fittings 140 are made by bending a sheet metal member in the through-thickness direction so as to make them point symmetrical to each other about the center of the receptacle connector 2 when viewed in the vertical direction.

As can be seen in FIG. 4, the retained fittings 140 have a planar mounting portion 141, which has its major faces perpendicular to the direction of the terminal array within an end wall 102 of the receiving-side housing 100 and which is embedded in said end wall 102 and bottom wall 103; a planar retained portion 142, which is positioned in the center of the receiving-side housing 100 in said connector width direction in an orientation such that its major faces are perpendicular to the connector width direction; and an anchoring portion 143, which extends in a crank-shaped configuration outwardly from the top edge (bottom edge in FIG. 3) of the mounting portion 141 in the terminal array direction. The retained fittings 140 similarly function as reinforcing fittings which, as a result of being held in place in the receiving-side housing 100, reinforce said receiving-side housing 100.

As can be seen in FIGS. 6(A) and 6(B), the upper end of the retained portion 142 is embedded in the bottom wall 103 and, in addition, of the two side edge portions extending in the vertical direction, the outer edge portion, which is positioned outwardly in the terminal array direction, is embedded in the end wall 102 (see FIG. 3). In addition, as can be seen in FIGS. 6(A) and 6(B), the section that excludes the above-mentioned upper end and the above-mentioned outer edge portion upstands from the bottom wall 103 and is positioned within the space between the two ends of the mating concave portion 105 in the terminal array direction. When the connectors are in a mated state, this section located within the mating concave portion 105 constitutes a retained plate portion 142A, which is clamped and held in place by the pair of resilient clamping pieces 62A of the retaining fitting 60 provided in the plug connector 1 (see FIG. 6(B)).

As can be seen in FIG. 3, the anchoring portions 143, which project outwardly from the bottom of the end walls 102 in the terminal array direction at outboard locations in the connector width direction, extend in a crank-shaped configuration curved downwardly and then outwardly in the terminal array direction. The distal ends of said anchoring portions 143 extending outwardly in the terminal array direction are positioned at the same height as the connecting portions 124, 134 of the receptacle terminals 120, 130 and are secured in place via solder connections to the corresponding portions of the other circuit board.

As can be seen in FIG. 4, the anchor fittings 150, which have a configuration obtained by omitting the retained portion 142 and the section of the mounting portion 141 located inboard in the connector width direction from the previously discussed retained fittings 140, are made by bending a strip-shaped sheet metal member in the through-thickness direction. As can be seen in FIG. 3, said anchor fittings 150 are provided via integral molding with the end walls 102 at outboard locations on the side opposite to the anchoring portions 143 of the retained fittings 140 in the connector width direction. As can be seen in FIG. 4, said anchor fittings 150 have mounting portions 151, which are embedded in the end walls 102 extending in the vertical direction, and anchoring portions 152, which extend in a crank-shaped configuration outwardly from the upper ends (lower ends in FIG. 3) of said mounting portions 151 in the terminal array direction. While being of the same shape as the anchoring portions 143 of the retained fittings 140, said anchoring portions 152 are located at the same height as said anchoring portions 143 and are secured in place via solder connections to the corresponding portions of the other circuit board. The anchor fittings 150 similarly function as reinforcing fittings which, as a result of being held in place in the end walls 102 of the receiving-side housing 100, reinforce said receiving-side housing 100.

Next, the steps involved in the manufacture of the receptacle connector 2 will be described with reference to FIGS. 8(A) through 10(B). First, carrier-equipped reinforcing fitting blanks P4 are placed in a mold (not shown). In said reinforcing fitting blanks P4, a single carrier is coupled to a retained fitting 140 via a strip-like piece P4A and to an anchor fitting 150 via a strip-like piece P4B. At the time when the reinforcing fitting blanks P4 are disposed in the mold, the strip-like pieces P4A, P4B have a rectilinear configuration extending in the direction of the terminal array, and the anchoring portions 143 of the retained fittings 140, as well as the anchoring portions 152 of the anchor fittings, are not yet formed.

Next, a receiving-side housing 100 is molded by injecting a molten electrically insulating material (plastic, etc.) into the mold and solidifying it therein. As a result, the reinforcing fitting blanks P4 are molded integrally with the receiving-side housing 100.

Figure 8A:
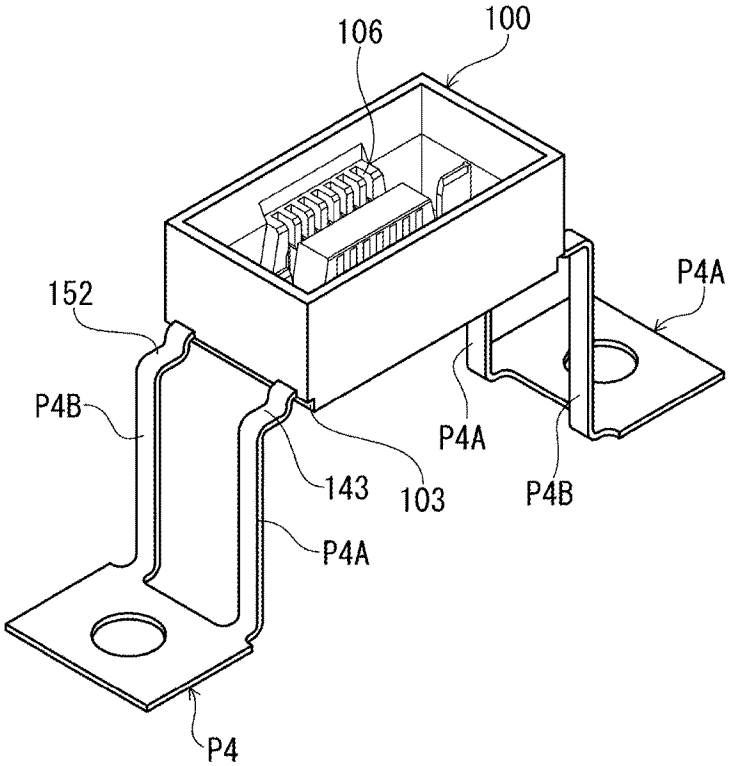

Next, as can be seen in FIGS. 8(A) and 8(B), sections of the strip-like pieces P4A, P4B projecting in the direction of the terminal array from the receiving-side housing 100 are bent in a crank-shaped configuration in the through-thickness direction, thereby forming the anchoring portions 143 of the retained fittings 140 and the anchoring portions 152 of the anchor fittings. At such time, the locations where the projecting sections of the strip-like pieces P4A, P4B are bent (locations in the direction of protrusion of the projecting sections (terminal array direction)) are determined by the height dimension of the board housing 110. As can be seen in FIGS. 8(A) and 8(B), in the present example implementation, the anchoring portions 143, 152 are formed by bending the strip-like pieces P4A, P4B at locations in the vicinity of the receiving-side housing 100 in the above-mentioned direction of protrusion.

Thus, in the present example implementation, as a result of providing long strip-like pieces P4A, P4B in the reinforcing fitting blanks P4, when the height dimension of the board-side housing 110 is modified in response to a change in the height dimension settings of the entire receptacle housing 90, the anchoring portions 143, 152 can be formed by bending the strip-like pieces P4A, P4B at locations (locations in the longitudinal direction of the strip-like pieces P4A, P4B) corresponding to the modified height dimension of the board-side housing 110. Consequently, in accordance with the present example implementation, the retained fittings 140 and anchor fittings 150 provided in many types of connectors of different heights can be made from a single type of stock material and increases in manufacturing costs can be minimized accordingly.

Figure 9B:
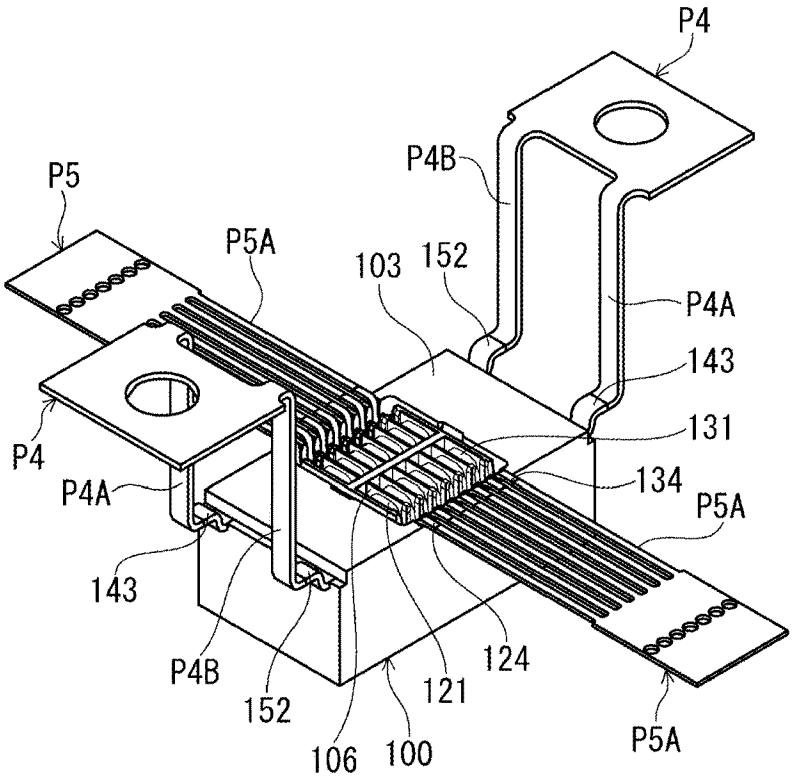
Figure 9A:
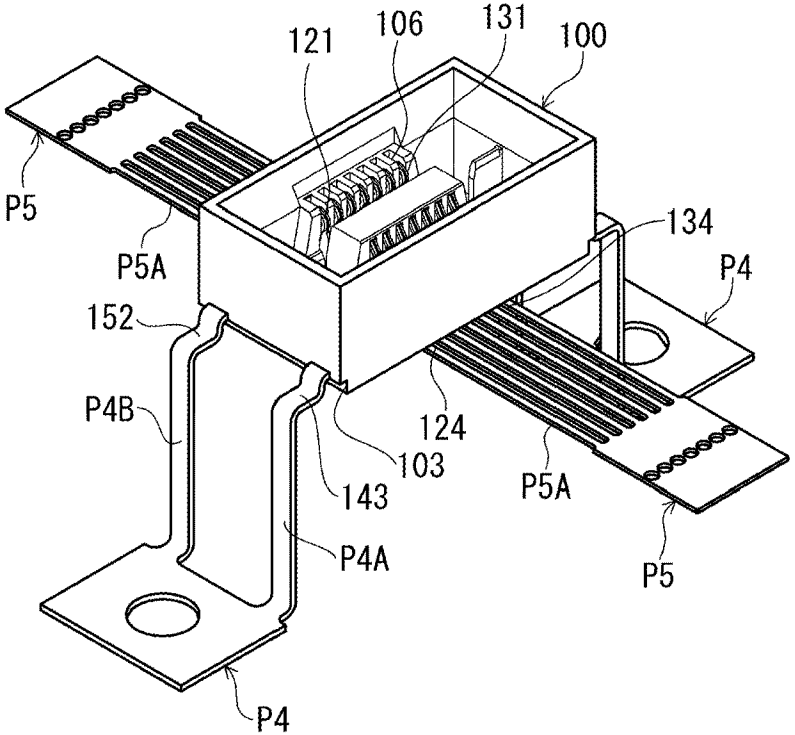

Next, the inverted U-shaped receiving portions 121, 131 of carrier-equipped receptacle terminal blanks P5 are received in the terminal holding portion 106 of the receiving-side housing 100 from the side of the bottom wall 103 of said receiving-side housing 100 (bottom side in FIG. 9(A), top side in FIG. 9(B)). In said receptacle terminal blanks P5, a single carrier is coupled with all of the receptacle terminals 120, 130 via thin strips P5A. At the moment when the inverted U-shaped receiving portions 121, 131 of the receptacle terminal blanks P5 are accommodated within the receiving-side housing 100, the strip-like pieces P5A have a rectilinear configuration extending in the connector width direction and the connecting portions 124, 134 of the receptacle terminals 120, 130 are not yet formed.

Next, as can be seen in FIGS. 9(A) and 9(B), sections of the strip-like pieces P5A projecting from the receiving-side housing 100 in the direction of the terminal array are bent in the through-thickness direction in a crank-shaped configuration, thereby forming the connecting portions 124, 134 of the receptacle terminals 120, 130. At such time, the locations where the projecting sections of the strip-like pieces P5A are bent (locations in the direction of protrusion of the projecting sections (connector width direction)) are determined by the height dimension of the board housing 110. As can be seen in FIGS. 9(A) and 9(B), in the present example implementation, the connecting portions 124, 134 are formed by bending the strip-like pieces P5A at locations in the vicinity of the receiving-side housing 100 in the above-mentioned direction of protrusion.

Thus, in the present example implementation, as a result of providing long thin strips P5A in the receptacle terminal blanks P5, when the height dimension of the board-side housing 110 is modified in response to a change in the height dimension settings of the entire receptacle housing 90, the connecting portions 124, 134 can be formed by bending the thin strips P5A at locations (locations in the longitudinal direction of the thin strips P5A) corresponding to the modified height dimension of the board-side housing 110. Consequently, in accordance with the present example implementation, the receptacle terminals 120, 130 provided in many types of connectors of different heights can be made from a single type of stock material and increases in manufacturing costs can be minimized accordingly.

Figure 10B:
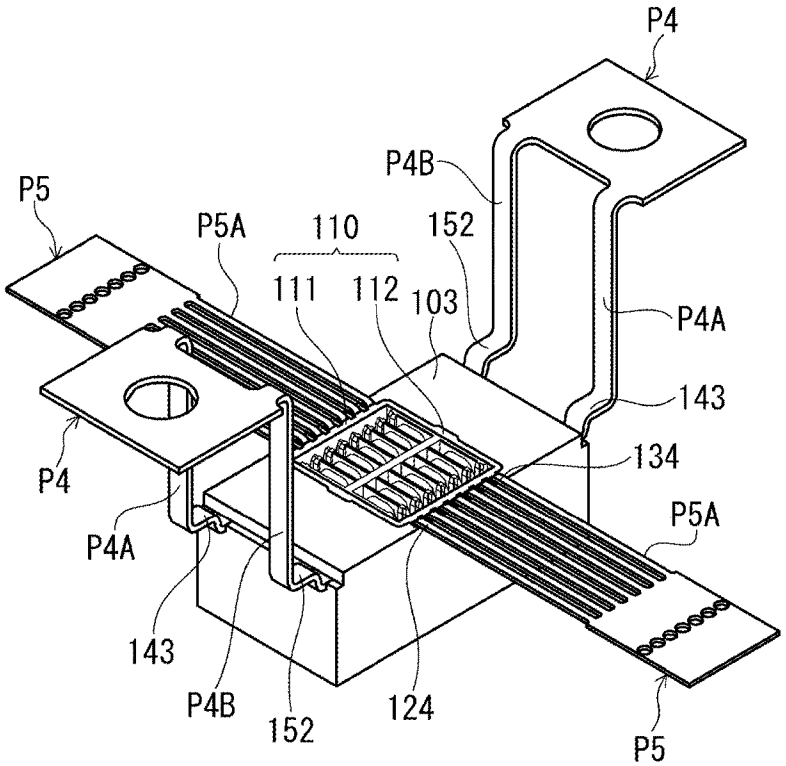
Figure 10A:
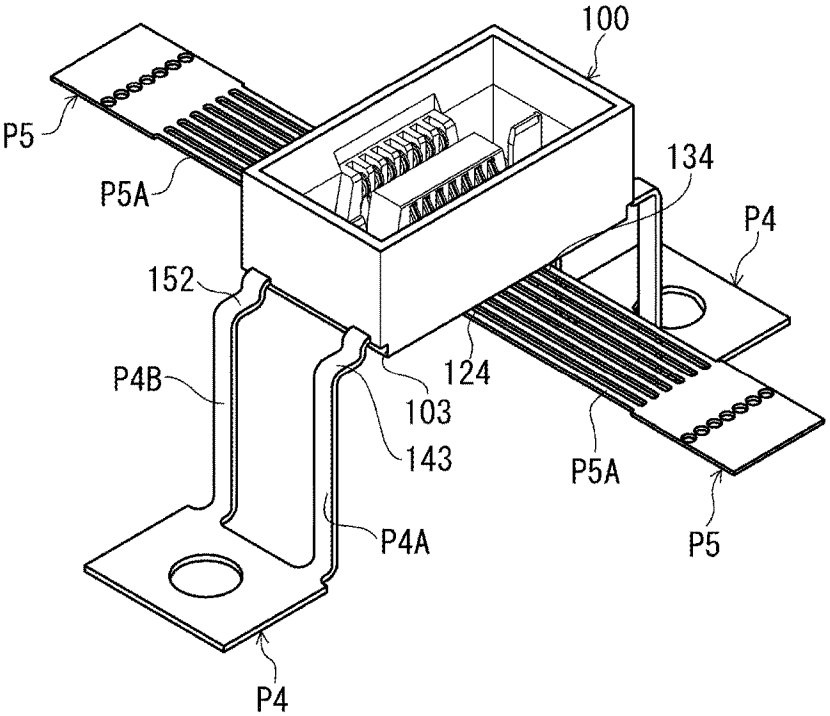

Next, as can be seen in FIGS. 10(A) and 10(B), the board-side housing 110 (shown in FIG. 10(B) only) is molded integrally with both the receiving-side housing 100 and the receptacle terminal blanks P5. As a result, the board-side housing 110 secures the retained arm portions 123, 133 of the receptacle terminals 120, 130 in the side walls 111 contained within the lateral recessed portions 103A-1 (see FIG. 8(B)) of the receiving-side housing 100 (see also FIG. 5(A)). The strip-like pieces P4A, P4B of the reinforcing fitting blanks P4 and the thin strips P5A of the receptacle terminal blanks P5 are then removed at predetermined locations in the longitudinal direction and each respective carrier is separated, thereby completing fabrication of the receptacle connector 2. Since in the present example implementation the board-side housing 110 is molded as a single piece not only with the receptacle terminal blanks P5 but also with the receiving-side housing 100, it is possible to improve not only the strength of the receptacle housing 90 itself, but also the holding force between the receptacle terminals 120, 130 and the receptacle housing 90.

The operation of mating the plug connector 1 and the receptacle connector 2 will be described next with reference to FIGS. 5(A) to 6(B).

First, the plug connector 1 and the receptacle connector 2 are respectively mounted to corresponding circuit boards (not shown). Specifically, in the plug connector 1, the connecting portions 41, 51 of the plug terminals 40, 50 are solder-connected to the corresponding circuitry of a circuit board, and the anchoring portions 83 of the anchor fittings 80 are solder-connected to the corresponding portions of this circuit board. In addition, in the receptacle connector 2, the connecting portions 124, 134 of the receptacle terminals 120, 130 are solder-connected to the corresponding circuitry of another circuit board, and the anchoring portions 143 of the retained fittings 140 and the anchoring portions 152 of the anchor fittings 150 are solder-connected to the corresponding portions of this other circuit board.

In this state, as can be seen in FIG. 5(A) and FIG. 6(A), which show the orientation immediately prior to mating, the receptacle connector 2 is positioned above the plug connector 1 with its mating concave portion 105 opened downwardly. Thereafter, the receptacle connector 2 is lowered along with the other circuit board to which said receptacle connector 2 is mounted (see arrows in FIG. 5(A), FIG. 6(A)). As this receptacle connector 2 descends, the mating portion 31 of the movable housing 30 of the plug connector 1 enters the mating concave portion 105 of said receptacle connector 2 from below and, at the same time, the center wall 104 of said receptacle connector 2 enters the receiving portion 33 of the movable housing 30 of the plug connector 1 from above (see FIG. 5(B)). As a result, the plug connector 1 and the receptacle connector 2 become mated with one another in the normal position illustrated in FIG. 5(B) and FIG. 6(B).

In the process of connector mating, when the receptacle connector 2 is pushed into the movable housing 30 of the plug connector 1 from above, the movable housing 30 travels downwardly as a result of resilient displacement of the horizontal resilient portions 43A, 53A of the plug terminals 40, 50. Due to the fact that in the present example implementation the abutment portions 72 of the abutment fittings 70 are exposed on the bottom face of the movable housing 30, it is not the bottom face of the movable housing 30 but the abutment portions 72 of the above-mentioned abutment fittings 70 that abut the mounting face of the circuit board with the abutment surfaces 72A. As a result, the movable housing 30 never abuts the circuit board and damage to the movable housing 30 is prevented.

When the connectors are in a mated state, the inverted U-shaped insertion portions 42, 52 of the plug terminals 40, 50 enter the inverted U-shaped receiving portions 121, 131 of the receptacle terminals 120, 130 from below and are clamped by the contact portions 121B-1, 121C-1, 131B-1, 131C-1 of said inverted U-shaped receiving portions 121, 131 in the connector width direction. In such a clamped state, the receptacle signal terminals 120 have their signal-type contact portions 121B-1, 121C-1 brought into contact with the signal-type contact portions 42A, 42B of the plug signal terminals 40 under contact pressure and, in addition, receptacle power supply terminals 130 have their power supply-type contact portions 131B-1, 131C-1 brought into contact with the power supply-type contact portions 52A, 52B of the plug power supply terminals 50 under contact pressure (see FIG. 5(B)). As a result, the receptacle terminals 120, 130 and the plug terminals 40, 50 are placed in electrical communication.

In addition, as can be seen in FIG. 6(B), when the connectors are in a mated state, the retained plate portions 142A of the retained fittings 140 of the receptacle connector 2 enter between the pair of resilient clamping pieces 62A of the retaining fittings 60 of the plug connector 1 and are clamped and held in the connector width direction (in the through-thickness direction of the retained plate portion 142A) by the clamping portions 62A-1 of the pair of resilient clamping pieces 62A. As a result, the locations of contact between the plug terminals 40, 50 and the receptacle terminals 120, 130 are maintained in an adequate manner.

In the present example implementation, the retaining fittings 60 and the retained fittings 140 are located outside of the terminal array range, with the pair of resilient clamping pieces 62A of the retaining fittings 60 clamping and holding the retained plate portions 142A of the retained fittings 140. Thus, the retaining fittings 60 and the retained fittings 140 are provided in the vicinity of the ends of the connectors 1, 2 in the terminal array direction. In other words, when viewed in the vertical direction, they are located sufficiently far from the vertical axes (axial lines extending in the vertical direction) passing through the mid-width locations of each respective connector 1, 2, as well as the horizontal axes (axial lines extending in the connector width direction) passing through the central locations in the terminal array direction of the connectors 1, 2. As a result, the connectors can withstand torque that may be inadvertently generated about the above-mentioned vertical axes and about the above-mentioned horizontal axes and can sufficiently maintain a state of contact between terminals.

The mating position of the receptacle connector 2 with respect to the plug connector 1 is not necessarily limited to the normal position in the terminal array direction, connector width direction, and vertical direction. Since the receptacle connector 2 is mounted to a circuit board and the view of the plug connector 1 is shielded by this circuit board, mating in a position offset from the above-mentioned normal position is likely to occur. In the present example implementation, the offset of the connectors 1, 2 is absorbed by the movement of the movable housing 30 in the direction of offset as a result of resilient displacement of the resilient portions 43, 53 of the plug terminals 40, 50. Specifically, offset in the vertical direction is primarily absorbed by the resilient displacement of the horizontal resilient portions 43A, 53A of the above-mentioned resilient portions 43, 53. In addition, offset in the terminal array direction and in the connector width direction is absorbed by the resilient displacement of the curved resilient portions 43B, 53B of the above-mentioned resilient portions 43, 53.

DESCRIPTION OF THE REFERENCE NUMERALS

1 Plug connector
2 Receptacle connector
10 Plug housing
20 Stationary housing
30 Movable housing
31 Mating portion
33 Receiving portion
40 Plug signal terminal
41 Signal-type connecting portion
42 Inverted U-shaped insertion portion (movable-side retained portion)
42A Signal-type inner contact portion
42B Signal-type outer contact portion
43 Signal-type resilient portion
43A Horizontal resilient portion
43B Curved resilient portion
44 Stationary-side retained portion
50 Plug power supply terminal
51 Power supply-type connecting portion
53 Power supply-type resilient portion
53A Horizontal resilient portion
53B Curved resilient portion
54 Narrow resilient portion
60 Retaining fitting
61 Mounting portion
62 Retaining portion
62A Resilient clamping piece
63 Edge overhang portion
70 Abutment fitting
72 Abutment portion
72A Abutment surface
73 Lateral overhang portion
80 Anchor fitting
82 Coupling portion (exposed portion)
90 Receptacle housing
100 Receiving-side housing

110 Board-side housing
120 Receptacle signal terminal
121B-1 Signal-type inner contact portion
121C-1 Signal-type outer contact portion
124 Signal-type connecting portion
130 Receptacle power supply terminal
131B Power supply-type contact portion
140 Retained fitting
142A Retained plate portion
150 Anchor fitting

What is claimed is:

1. An electrical connector for circuit boards comprising:

terminals having formed therein connecting portions configured to be connected to a circuit board at one end in the longitudinal direction of said terminals and contact portions configured to be placed in contact with a counterpart connector component at the other end, and a housing holding a plurality of said terminals in array form; said housing comprising stationary housings, which are mounted to a circuit board by the terminals, and a movable housing, which is formed as a member separate from said stationary housings, that is movable relative to said stationary housings, and has disposed therein the contact portions of the terminals, wherein:

the terminals comprise stationary-side retained portions held in place by the stationary housings, movable-side retained portions held in place by the movable housing, and resilient portions provided between said stationary-side retained portions and movable-side retained portions, the stationary housings comprise stationary-side reinforcing fittings secured in place in said stationary housings via integral molding with said stationary housings and, the movable housing comprises movable-side reinforcing fittings secured in place in said movable housing via integral molding with said movable housing, the stationary-side reinforcing fittings comprise exposed portions exposed from the stationary housings at locations outside the terminal array range of the terminals in the terminal array direction, and the movable-side reinforcing fittings comprise expanded portions protruding from the movable housing at locations outside the array range.

2. The electrical connector for circuit boards according to claim 1, wherein the expanded portions of the movable-side reinforcing fittings and the exposed portions of the stationary-side reinforcing fittings are provided in mutually different locations in the vertical direction.

3. A method of manufacture of an electrical connector for circuit boards comprising terminals having formed therein connecting portions configured to be connected to a circuit board at one end in the longitudinal direction of said terminals and contact portions configured to be placed in contact with a counterpart connector component at the other end, and a housing holding a plurality of said terminals in array form; said housing comprising stationary housings, which are mounted to a circuit board by the terminals, and a movable housing, which is formed as a member separate from said stationary housings, that is movable relative to said stationary housings, and has disposed therein the contact portions of the terminals, the method comprising:

securing the terminals, which comprise stationary-side retained portions held in place by the stationary housings, movable-side retained portions held in place by the movable housing, and resilient portions provided between said stationary-side retained portions and movable-side retained portions, in place via integral molding with the above-mentioned stationary and movable housings and, securing a reinforcing fitting blank in place via integral molding in the stationary and movable housings so as to span the distance between said stationary and movable housings, and, after the terminals, the reinforcing fitting blank, and the stationary and movable housings are integrally molded together, severing parts of the reinforcing fitting blank exposed from both the stationary housings and the movable housing at locations outside of the terminal array range in the terminal array direction, with some material remaining after the severing operation, as a result of which the stationary-side reinforcing fittings secured in place in the stationary housings and movable-side reinforcing fittings secured in place in the movable housing are separated, and positioning the exposed portions of the stationary-side reinforcing fittings exposed from the stationary housings at locations outside the terminal array range and the expanded portions of the movable-side reinforcing fittings protruding from the movable housing at locations outside the above-mentioned terminal array range in close proximity but without direct contact.

4. The method of manufacture of an electrical connector for circuit boards according to claim 3, wherein the reinforcing fitting blank comprises a stepped portion with level differences in the vertical direction in a section located outside the terminal array range, and the above-mentioned reinforcing fitting blank is cut so as to excise the section that includes the above-mentioned stepped portion, thereby providing the exposed portions of the stationary-side reinforcing fittings and the expanded portions of the movable-side reinforcing fittings at different locations in the vertical direction.

* * * * *